US007461421B1

(12) United States Patent
Faircloth et al.

(10) Patent No.: US 7,461,421 B1
(45) Date of Patent: Dec. 9, 2008

(54) PLAY PILLOW WITH HIDING SPACE

(76) Inventors: Julia Sarah Faircloth, 11025 NE. Hurley La., Newburg, OR (US) 97132; Nellie Tara Faircloth, 11025 NE. Hurley La., Newburg, OR (US) 97132

( * ) Notice: Subject to any disclaimer, the term of this patent is extended or adjusted under 35 U.S.C. 154(b) by 517 days.

(21) Appl. No.: 10/661,698

(22) Filed: Sep. 12, 2003

(51) Int. Cl.
*A47G 9/00* (2006.01)

(52) U.S. Cl. ..... 5/639; 5/630; 5/640

(58) Field of Classification Search ..... 5/639–640, 5/693–694; 446/73; 206/457
See application file for complete search history.

(56) References Cited

U.S. PATENT DOCUMENTS

| | | | | |
|---|---|---|---|---|
| 1,470,598 | A | 10/1923 | Dessau | |
| 1,490,295 | A | 4/1924 | Stephens | |
| 1,768,334 | A | 6/1930 | Stein et al. | |
| 3,175,230 | A * | 3/1965 | Herdal | 5/491 |
| 3,378,948 | A * | 4/1968 | Gervaise | 446/81 |
| 3,400,413 | A | 9/1968 | La Grossa | |
| 3,789,546 | A | 2/1974 | Morrison | |
| 4,091,481 | A * | 5/1978 | Redman | 5/639 |
| 4,288,879 | A | 9/1981 | Pate | |
| 4,309,784 | A | 1/1982 | Cohen | |
| D269,575 | S | 7/1983 | Fogarty et al. | |
| 4,468,824 | A | 9/1984 | O'Hanlan | |
| D282,427 | S | 2/1986 | O'Sullivan | |
| 4,688,286 | A * | 8/1987 | Miker, Jr. | 5/490 |
| 4,768,245 | A | 9/1988 | Dutton | |
| 4,774,734 | A | 10/1988 | Mills | |
| 4,853,994 | A | 8/1989 | Ekstein | |
| 4,866,800 | A | 9/1989 | Bedford | |
| 4,873,736 | A | 10/1989 | Sapp et al. | |
| 4,874,340 | A | 10/1989 | Smallwood | |
| D305,711 | S | 1/1990 | Wood | |
| D306,112 | S | 2/1990 | Forsland | |
| 4,914,765 | A | 4/1990 | Smith | |
| D308,311 | S | 6/1990 | Forsland | |
| D317,994 | S | 7/1991 | Collins | |
| 5,118,318 | A | 6/1992 | Lorizio | |
| D338,798 | S | 8/1993 | Grzybinski | |
| D346,086 | S | 4/1994 | Jones | |
| D357,595 | S | 4/1995 | Roschacher | |
| D364,464 | S | 11/1995 | Gigante et al. | |
| D372,829 | S | 8/1996 | Sircy | |
| D383,026 | S | 9/1997 | Torbik | |
| D388,649 | S | 1/1998 | Chekuri | |

(Continued)

OTHER PUBLICATIONS

"Noah's Ark," Fabric Crafting, Newfield Publications, Inc., No. D3 058 01-18.

*Primary Examiner*—Fredrick Conley
(74) *Attorney, Agent, or Firm*—Joseph P. Curtin, L.L.C.

(57) ABSTRACT

A soft play pillow having a secret hiding place cavity concealed by a door. An item such as a small stuffed animal or toy is hidden in the secret hiding place to intrigue children and entice them to play a quiet game of game of peek-a-boo with the pillow and the item inside. The soft pillow preferably has indicia which together with the item visually indicate an illustrated theme, such as, an animal barn or building theme, frog and lily pad theme, horse theme, religious theme, vehicular theme or bear theme. The soft pillow may include additional cavities and additional doors, and may further include places to hold books and pictures.

27 Claims, 24 Drawing Sheets

U.S. PATENT DOCUMENTS 5,778,468 A * 7/1998 Saarela et al. ..... 5/636
D397,576 S 9/1998 Friedman
D397,902 S 9/1998 Knorrek
5,893,605 A * 4/1999 Chang ..... 297/188.14
5,916,088 A 6/1999 Gueli
5,951,111 A * 9/1999 Klimenko ..... 297/452.41
5,970,546 A 10/1999 Danis
6,038,719 A 3/2000 Castagna
6,105,188 A * 8/2000 Perez-Mesa et al. ..... 5/655
6,106,360 A 8/2000 Jenkins et al.
6,233,763 B1 * 5/2001 Spaan ..... 5/485
6,236,621 B1 5/2001 Schettino
6,256,965 B1 7/2001 Sheridan
6,267,638 B1 7/2001 Connolly et al.
6,406,098 B1 6/2002 Linder
6,427,265 B1 8/2002 Dix
6,434,769 B1 * 8/2002 Koenig ..... 5/636
6,525,268 B1 2/2003 Sellers
D476,184 S 6/2003 Hall
6,941,601 B2 * 9/2005 DeBartolo et al. ..... 5/639

* cited by examiner

PLAY PILLOW WITH HIDING SPACE

BACKGROUND OF THE INVENTION

1. Field of the Invention

This invention relates to a pillow having one or more secret hiding places. More particularly, this invention relates to a pillow with one or more cavities, at least one of the cavities concealed by a door for the purpose of concealing at least one item removeably placed in the at least one cavity. Still more particularly, the pillow has indicia which together with the at least one item visually illustrate a theme. The invention further relates to a pillow where children are enticed to play a quiet game of peek-a-boo with the pillow and the item, especially when the item is a small stuffed animal or toy.

2. Description of Related Art

Pillows have long been used for a variety of purposes. Related patents show pillows which function as playthings, as storage for books and small toys, as a source for effectuating feelings of safety and security and as a source of physical comfort.

For example, U.S. Design Pat. 397,902, issued to Knorrek, shows an ornamental activity pillow. U.S. Pat. No. 5,778,468, issued to Saarela et al., discloses a pillow for toting an angelic companion with pockets storing a doll and a book. U.S. Pat. No. 6,256,965 B1, issued to Sheridan, discloses a method for designing and fabricating a bed. U.S. Design Pat. D476,184S, issued to Hall, shows a gift pillow with a pocket. U.S. Pat. No. 4,768,245, issued to Dutton, discloses a pillow with a book in a pocket. U.S. Pat. No. 6,427,265 B1, issued to Dix, discloses an interactive blanket and pillow for children.

U.S. Pat. No. 6,434,769 B1, issued to Koenig, discloses a plush character having a pouch for storybooks and puppets, and a puppet stage with fold down base which may be removeable from the character pillow. U.S. Pat. No. 3,400,413, issued to Grossa, shows a contour pillow. U.S. Pat. No. 1,490,295, issued to Stephens, teaches a book with a compartment holding a toy figure and with a door. U.S. Pat. No. 6,038,719, issued to Castagna, shows a pillow with a slit to a cavity for holding a phallic member and shows a slit closure hook and loop strip in FIG. 6. U.S. Pat. No. 6,236,621 B1, issued to Schettino, discloses a pillow alarm device having an alarm clock in a pillow compartment and mounted to a pillow flap. U.S. Pat. No. 6,525,268 B1, issued to Sellers, discloses a pillow for housing one or more electronic devices.

Despite the number of patents that have issued, the art lacks among other things a pillow that can fulfill the above functions and furthermore can be used by children for the game of hide-and-seek or peek-a-boo yet can also serve as a traditional pillow for comfort or decoration. The art lacks a pillow having at least one hiding space behind a door for one or more removeable items, and also lacks a hiding place that can snuggly hold the removeable items. The art also lacks, among other things, a pillow having a door and cavity as described and with an overall visual theme illustrated by indicia on pillow and by a removeable item stowed inside a cavity in the pillow.

SUMMARY OF THE INVENTION

Despite the number of patents that have issued, none are known to disclose a pillow with a hidden cavity as claimed that is intriguingly attractive to children and adults due to natural curiosity to want to peek behind a door. One would not anticipate a hiding place within a pillow. The related art does not teach or suggest a pillow with a cavity as described concealed by a door which serves as a hiding place for removeable items. Furthermore, none of the related art discloses or suggests a hiding place in a pillow for items, such as, toys and stuffed animals, for children to play hide-and-seek or peek-a-boo with the items. None of the related patents show a pillow with a cavity as described for holding a removable item and a door for alternately revealing and concealing a removeable item. Furthermore, none of the related art discloses or suggests a pillow with the aforementioned and for functioning as a typical throw pillow, decoration, or other for which a pillow is generally used. This invention differs in part because it fulfills the above and also presents other additional and new features not yet shown or taught in the related art.

A unique feature of the invention includes a deep cavity for a purpose of holding or storing small stuffed animals or toys, and a door which can cleverly close and conceal the cavity in such a manner that a child can pretend that the pillow contains a secret hiding place for items placed behind the door. The cavity is structured in such a manner that with minimal effort a child can take a small toy or item and insert and remove it, and store and hide it again. The hidden cavity, or secret hiding place concept attracts children and adults due to a natural curiosity to want to peek behind a door.

Another unique feature of this invention is that this pillow can be used by children with or without assistance for actively playing the favorite age-old games of peek-a-boo or hide-an-seek. The combination of the cavity within the pillow and the addition of a door to conceal the cavity allows children to actively entertain themselves and stimulate imagination by providing the opportunity to engage in quiet comfortable play. One or more cavities are structured in such a manner that small objects can be inserted and removed from the cavity. The door or plurality of doors are designed to cleverly cover one or more cavities in such a manner that the pillow may appear as a typical throw pillow. Children are intrigued by the idea of hiding spaces, especially hiding spaces that are in unusual places. One would not expect a hiding space within a pillow. Thus, the combination of a pillow cavity and a pillow door allows children or even adults to amuse themselves.

Play pillows with the present features that provide a covered hiding space for small stuffed animals or children's toys are welcomed by those looking for new and unique gifts. Many children take their favorite pillow and/or favorite toy along while traveling or sleeping away from home. This invention could be used for this purpose and provide comfort. The features of the pillow stimulate curiosity and thus children, especially small children, can be entertained for long periods of time when they are engaged in peek-a-boo. The pillow allows children to insert one or more small objects into a cavity and then allows removal of the objects from the cavity. By opening and closing the door, the child can engage in the game of peek-a-boo with the object placed in the cavity. In addition, children can use the pillow for a source of comfort and security.

The shape of the pillow may vary from a typical square throw pillow and thereby be additionally attractive and enticing. For example, a front and back of the pillow may resemble a shape such as a building, animal, fish, boat, tree, doll, bed, star, flag, mailbox, flower, or vehicle, such as a car, truck or train, tractor, airplane, space ship or the like. For buildings or vehicles that generally have multiple windows, multiple cavities with respective doors could be provided. Shaped pillows are useful in visually illustrating a pillow theme. Various themes may be illustrated with the pillow. The pillow can also have cavities that are not covered by doors, or have cavities within cavities. Some embodiments, may have a sidewall that increases the pillow depth for installing deeper and larger cavities, and for providing more cavities within a single pillow.

In some embodiments, the pillow may comprise other geometric shapes, such as triangular, oblong, round or rectangular. The pillow door may comprise various other elements not shown in the preferred embodiment, for example, the door could have applique, iron-on pieces, removeably attached pieces, or soft three dimensional sculpture, which visually illustrate the theme of the pillow and are for enhancing the theme, play imagination, and appearance of the pillow. The pillow could include two doors covering one cavity. The doors could meet together like two barn doors, or be layered one on top of another to successively reveal a cavity. These are only examples of numerous possibilities which may be expounded upon from the hidden cavity and theme features. Note, all copyright, design and trademark rights for the various pillow designs are reserved by Applicant.

OBJECTIVES OF THE INVENTION

Objects of the present invention are:

(a) to provide a play pillow with at least one concealed cavity that has the capacity and structure to hold at least one small stuffed animal or toy; the at least one cavity being individually covered by a least one door; the at least one door being attached to at least one surface of the play pillow; the at least one door being attached in such a manner that it can be opened and closed to hide and then reveal a removeable item or stuffed toy placed inside the cavity.

(b) to provide a play pillow that has a theme which encourages imaginative play and stimulate curiosity for children and adults by offering a pillow with at least one cavity and at least one door covering cavity for the purpose of making a hiding place within the pillow.

(c) to provide a play pillow that when not being used for play may function as a typical throw pillow, decoration or any other suitable manner for which a pillow may be used.

(d) to provide a play pillow with at least one cavity structure that can snuggly hold yet allow small objects to be easily inserted and removed.

(e) to provide a play pillow with at least one door capable of opening and closing with little effort with or without assistance to provide opportunity for children to practice and develop their motor skills.

(f) to provide a play pillow kit that includes the play pillow and a blanket, and a container for carrying both; the blanket and container can match the pillow theme.

The present invention fulfills these objects and others and fulfills what is lacking from the art in part by providing a cushioning article having a cavity with a door for hiding an item and which preferably has a theme.

In a preferred embodiment of the invention, the pillow is generally square shaped, such that, the pillow resembles a typical throw pillow yet has a hiding cavity for concealing an item within the pillow.

In a preferred embodiment of the invention, the cavity opening has an area that is about eighteen percent, more preferably about twenty-three percent, or more of a frontal area encircled by an outer perimeter of the pillow.

In a preferred embodiment of the invention, indicia on the pillow and the item stowed away in the hiding cavity visually indicate an illustrated theme.

In a preferred embodiment of the invention, a sound device on or in the pillow or item further indicates the illustrated theme.

In a preferred embodiment, the cavity is concealed by a door. The door is pivotally attached, such that, in a closed position the cavity and one or more items placed in the cavity are concealed and in a pivoted open position the cavity and one or more items are revealed.

In a preferred embodiment, the cavity has a perimeter sidewall surface and floor surface which create a three-dimensional void of sufficient size for removeably receiving an item.

In a preferred embodiment of the invention, the pillow is made of quilted fabric for improved softness and appearance.

In another embodiment, the pillow has multiple cavities, one or more of which have doors for revealing and concealing items in the cavities.

In an embodiment, the pillow has at least one cavity with door, and at least one other cavity that is open and does not have a door for displaying an item in an nonconcealed manner.

In an embodiment, the pillow cavity has a sidewall that billows inward to snuggly yet releaseably hold an item in the cavity.

In an embodiment, the pillow has at least one cavity having a structure bridging at least a portion of the cavity for further illustrating the theme of the pillow, and in an embodiment the structural member may bridge across the cavity such that the structure can also hold an item in the cavity.

In an embodiment, the pillow is personalized with monogramming, pictures, text or other.

In an embodiment, the pillow has at least one cavity with a plurality of doors. The doors can meet together to conceal the cavity, or the doors can be layered one on top of another, or arranged otherwise to illustrate a theme or to provide a more intriguing play pillow.

In an embodiment, a tunnel connects two cavities to form a passageway therebetween.

In an embodiment, the pillow has securing means for securing the door in a closed position.

In an embodiment, the pillow has an outer outline shape visually illustrating the theme of the pillow.

In an embodiment, the pillow may be combined with a blanket and a container to form a pillow kit. The blanket has indicia that illustrates the pillow theme. The container can have a transparent portion and can have an indicia portion that illustrates the pillow theme.

Other objects, advantages and features of the invention will be more fully understood from the following detailed description and appended claims when taken with the accompanying drawings.

DETAILED DESCRIPTION OF THE PREFERRED EMBODIMENTS

Figure 1A:
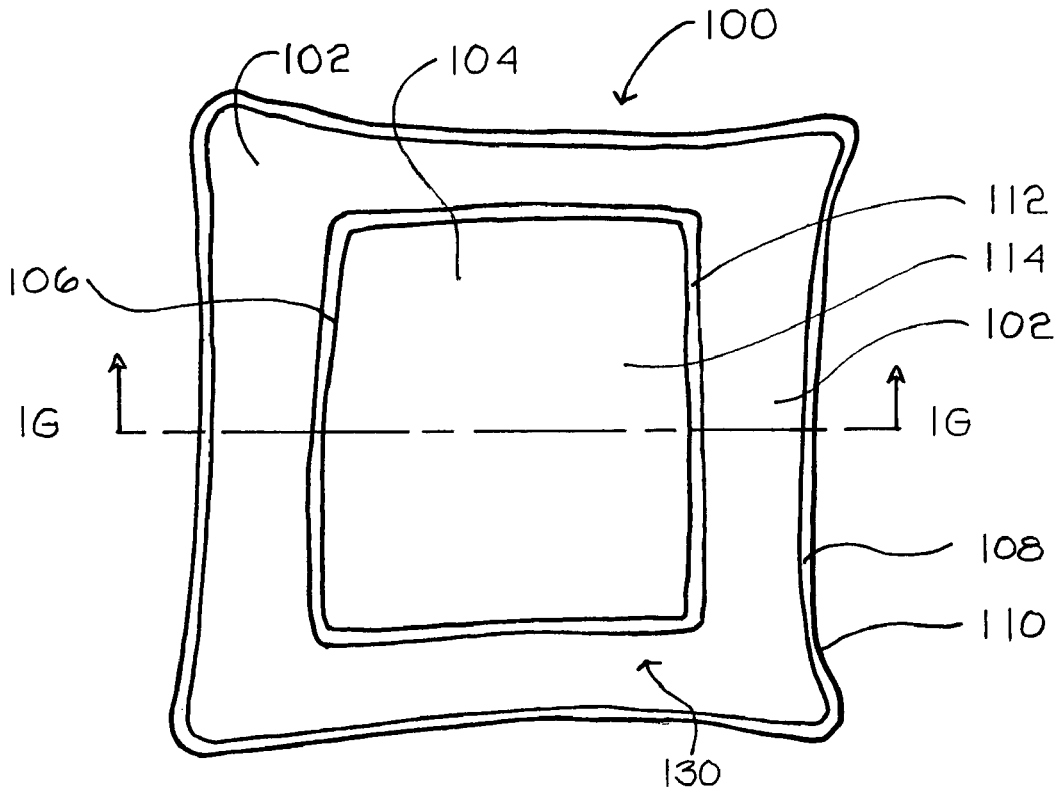
FIG. 1A is a front view showing a preferred embodiment of a pillow with a pillow door in a closed position.
Figure 1B:
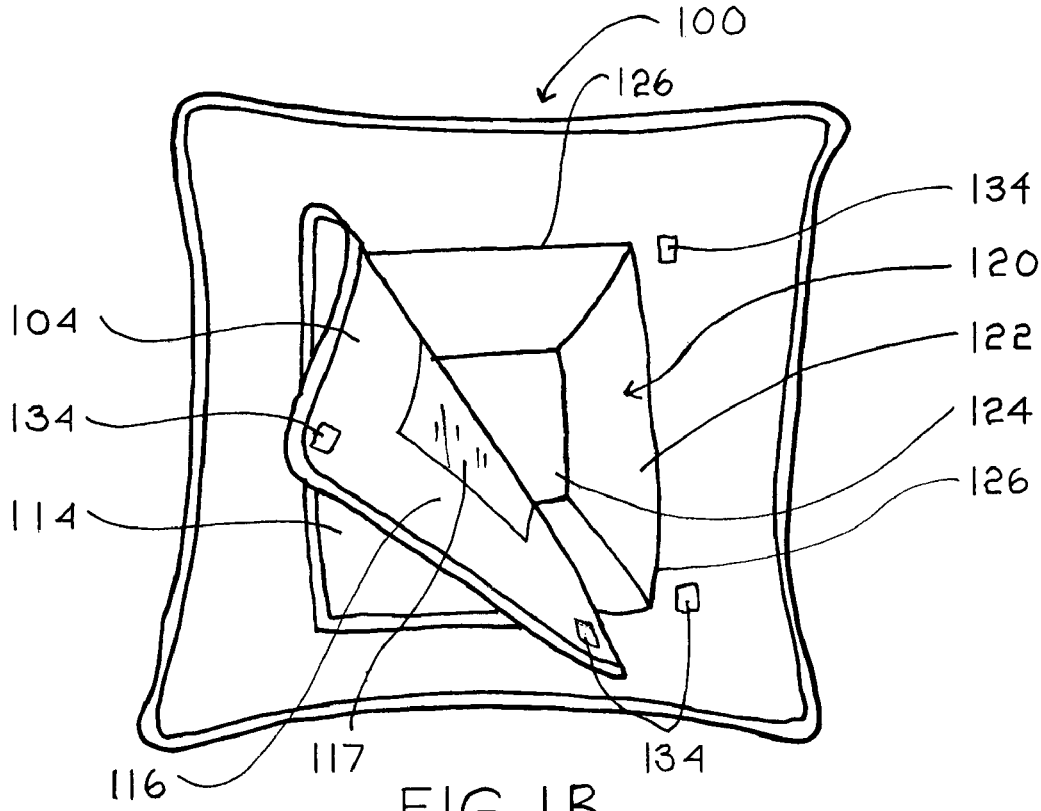
FIG. 1B is a front view of the pillow shown in FIG. 1A where the pillow door in a partially open position.
Figure 1C:
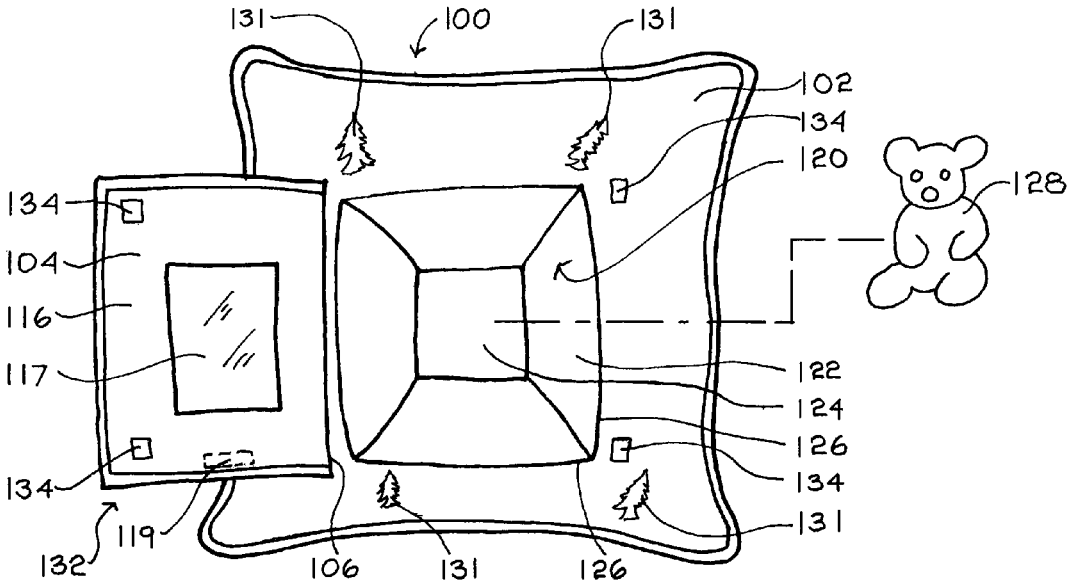
FIG. 1C is a front view of the pillow shown in FIG. 1A where the pillow door is fully open and showing a clear view of the pillow cavity without an item therein.
Figure 1D:
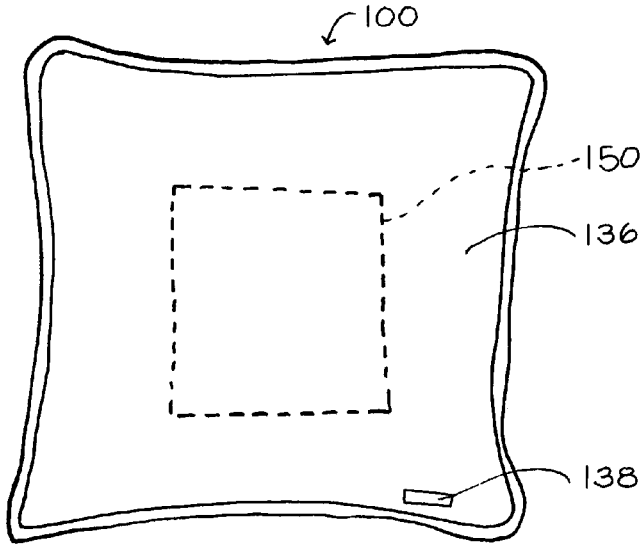
FIG. 1D is a back view of the pillow of FIG. 1A showing a hidden line at the cavity floor.
Figure 1E:
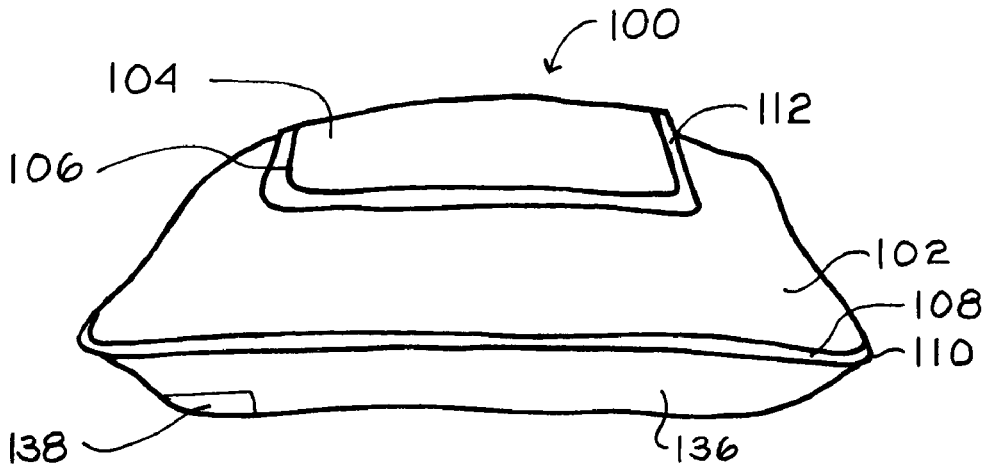
FIG. 1E is a perspective bottom view of the pillow shown in FIG. 1A.
Figure 1F:
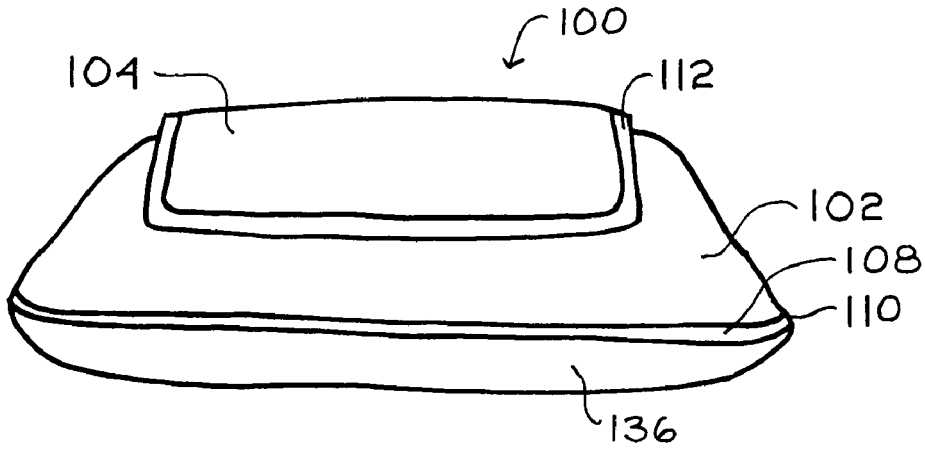
FIG. 1F is a perspective right view of the pillow shown in FIG. 1A.
Figure 1G:
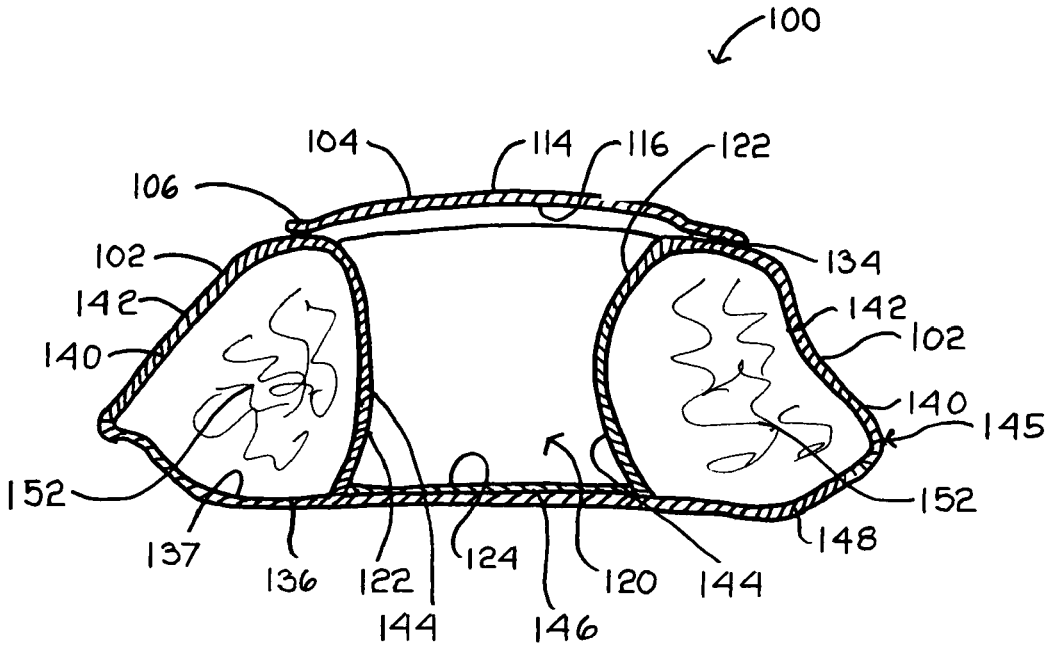
FIG. 1G is a cross-sectional view of the pillow of FIG. 1A taken along line 1G-1G.
Figure 1H:
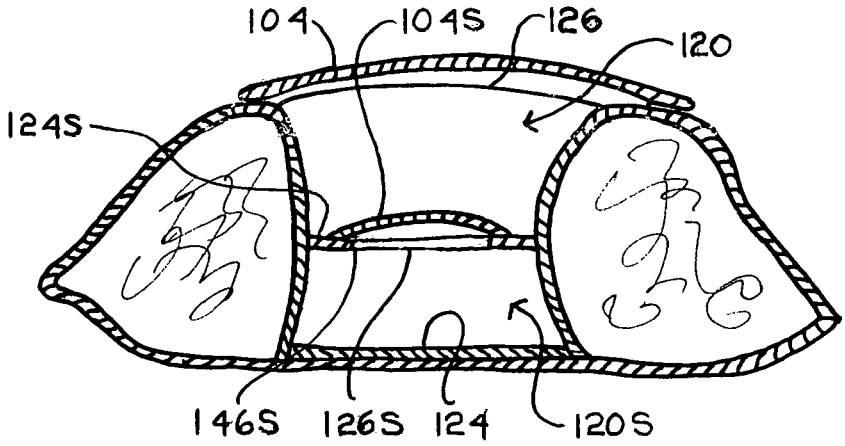
FIG. 1H is a cross-sectional view of an alternative pillow taken along a line similar to 1G-1G where a cavity within a cavity is shown.
Figure 2:
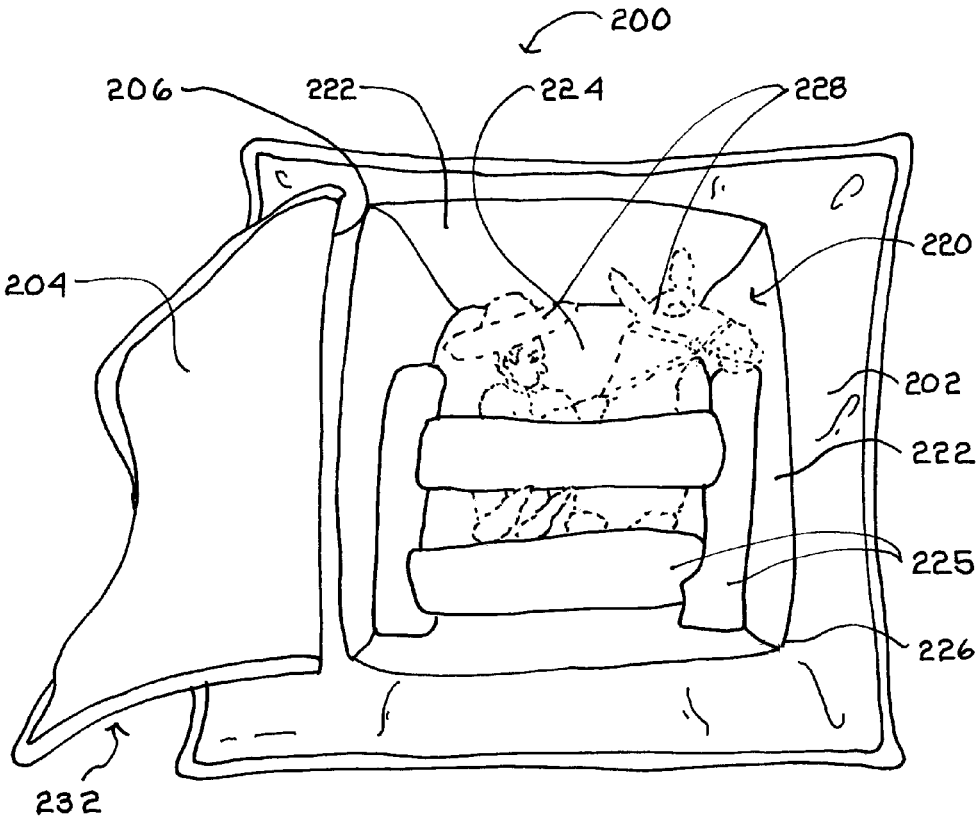
FIG. 2 is front perspective view of another embodiment.
Figure 6A:
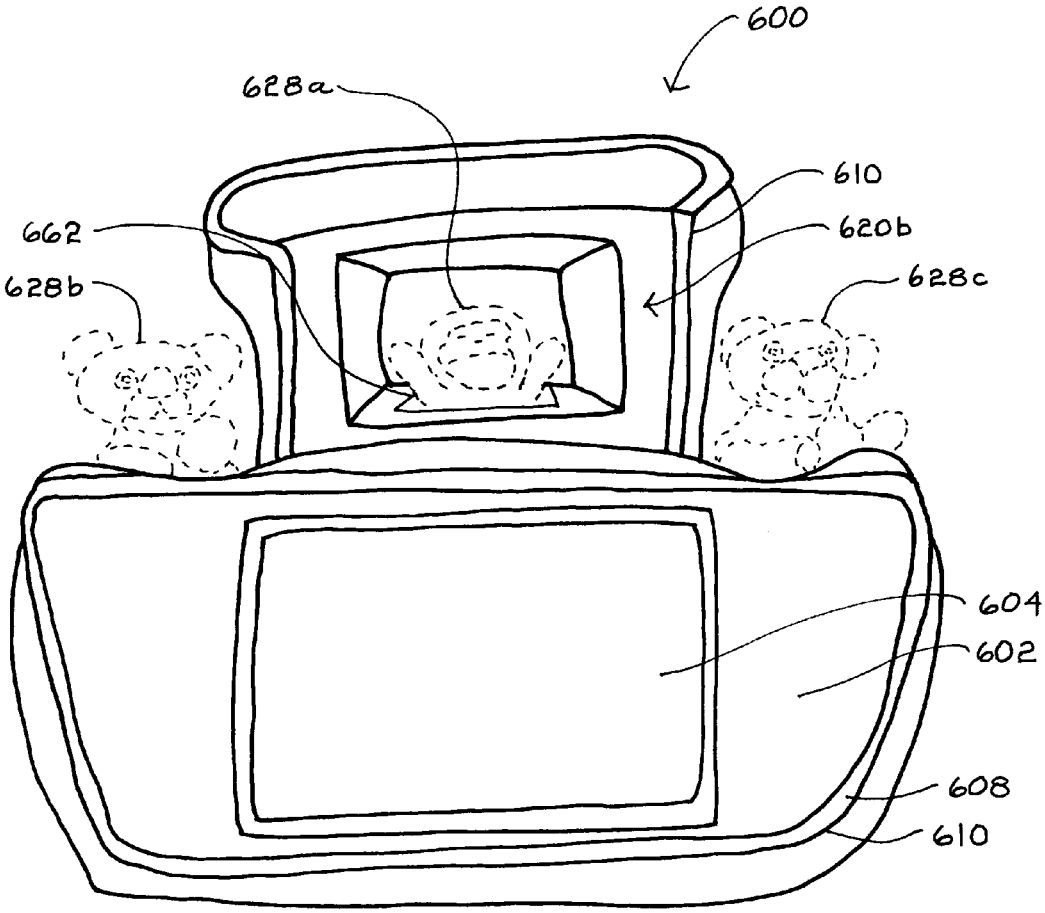
FIG. 6A is a front view of a pillow of another embodiment with a door closed.
Figure 6B:
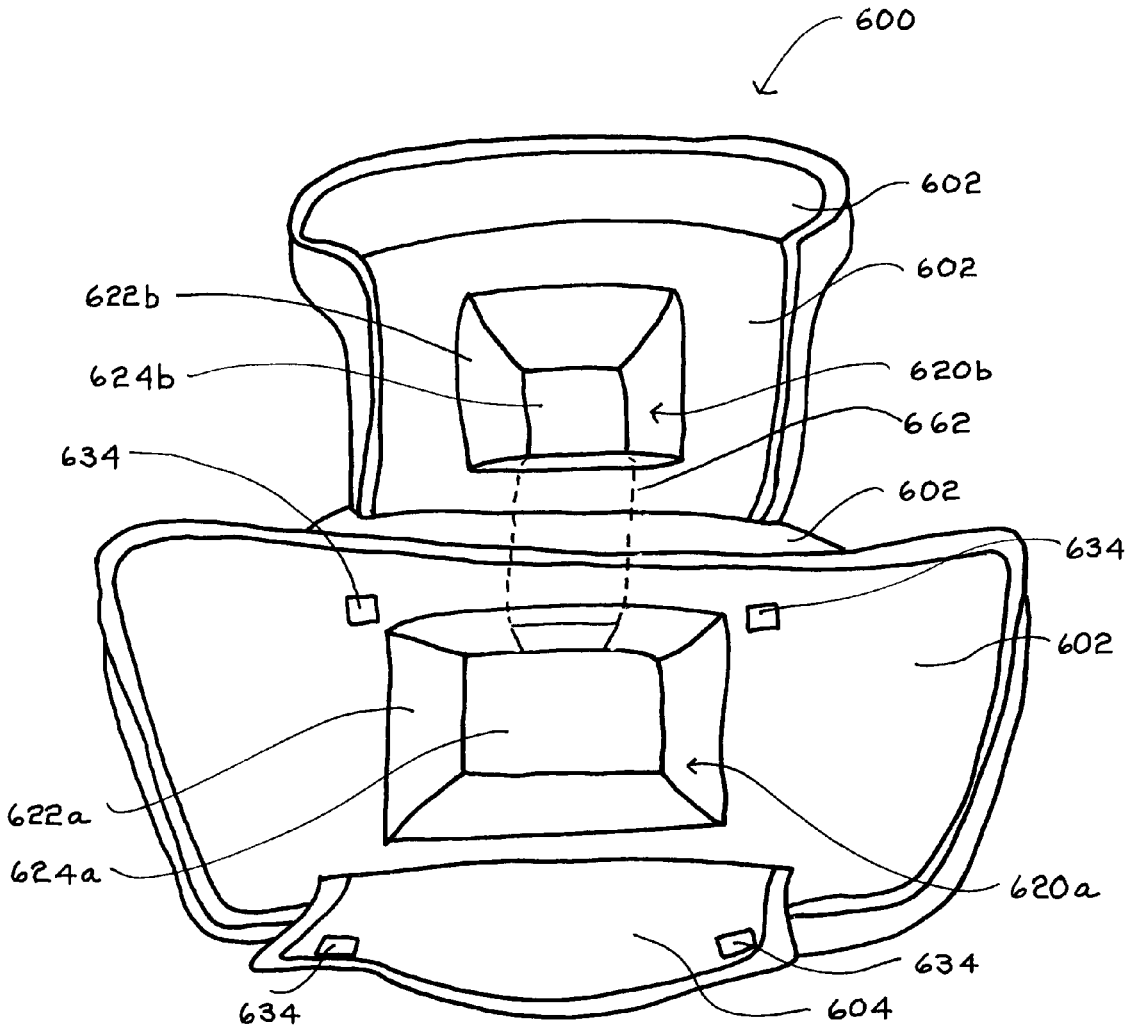
FIG. 6B is a front view of the pillow of FIG. 6A showing the door in an open position.
Figure 6C:
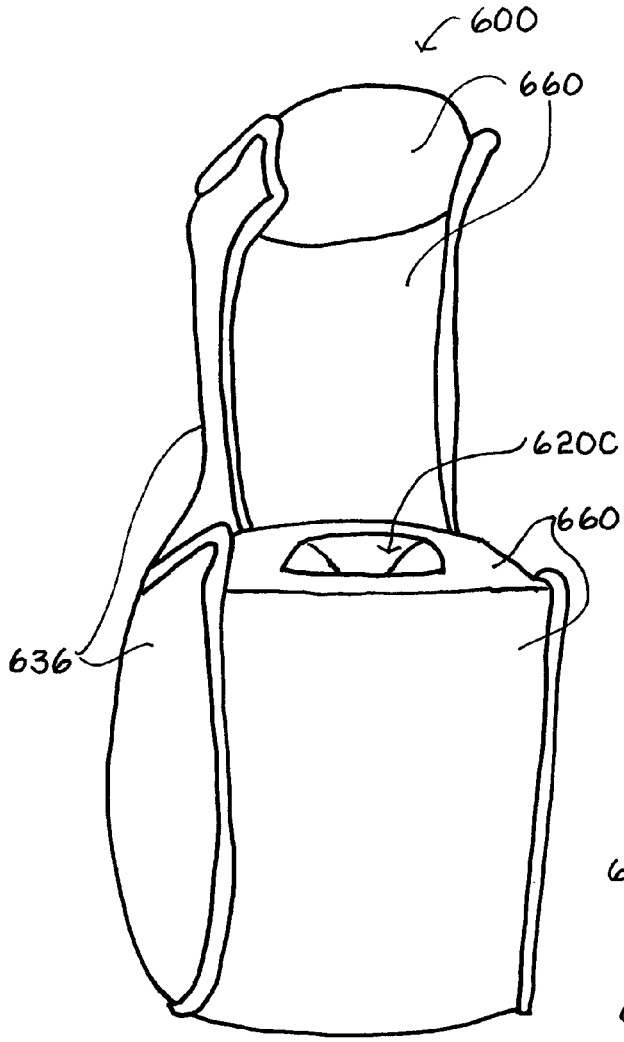
FIG. 6C is a left perspective view of the pillow of FIG. 6A.
Figure 6D:
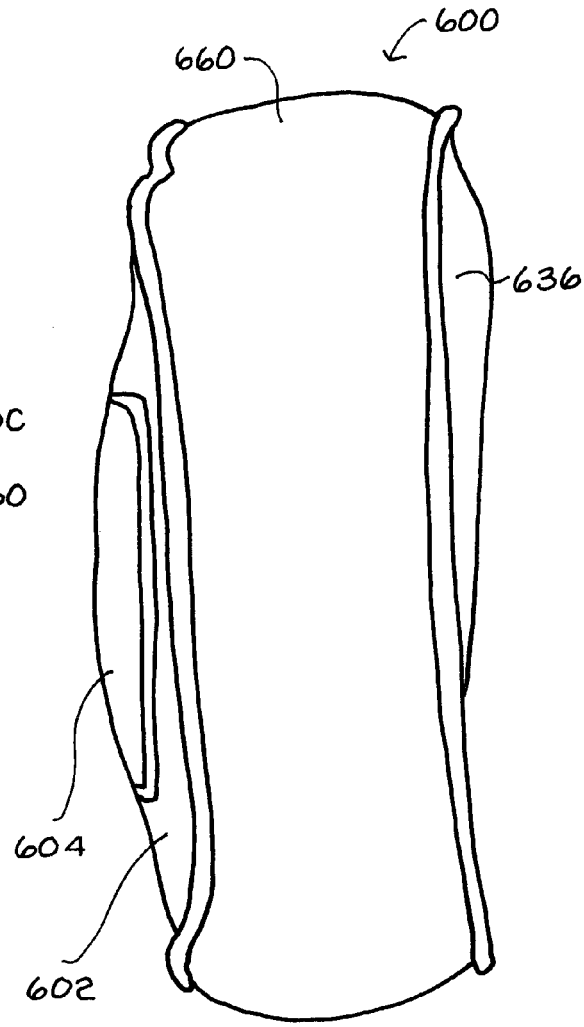
FIG. 6D is a bottom perspective view of the pillow of FIG. 6A.
Figure 6E:
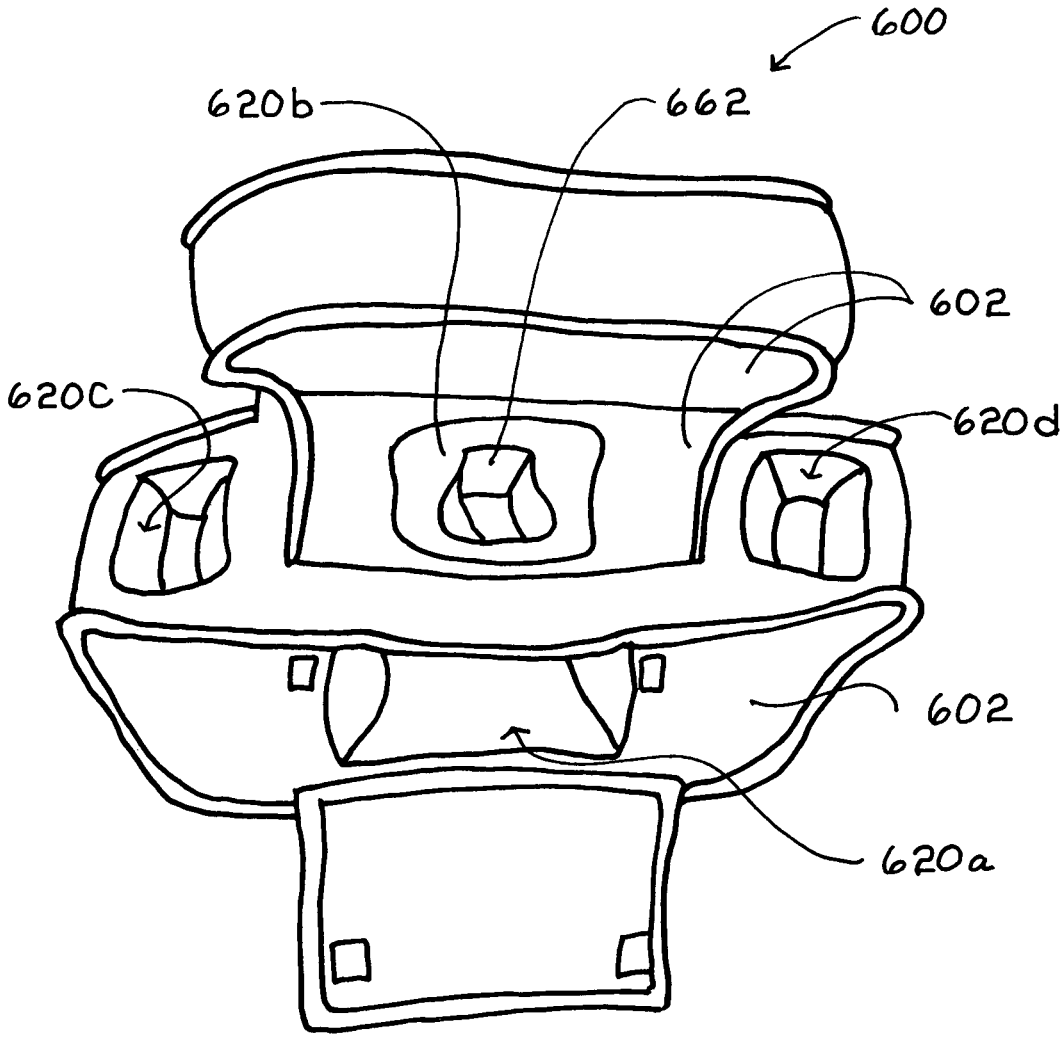
FIG. 6E is a top perspective view of the pillow shown in FIG. 6B.
Figure 7A:
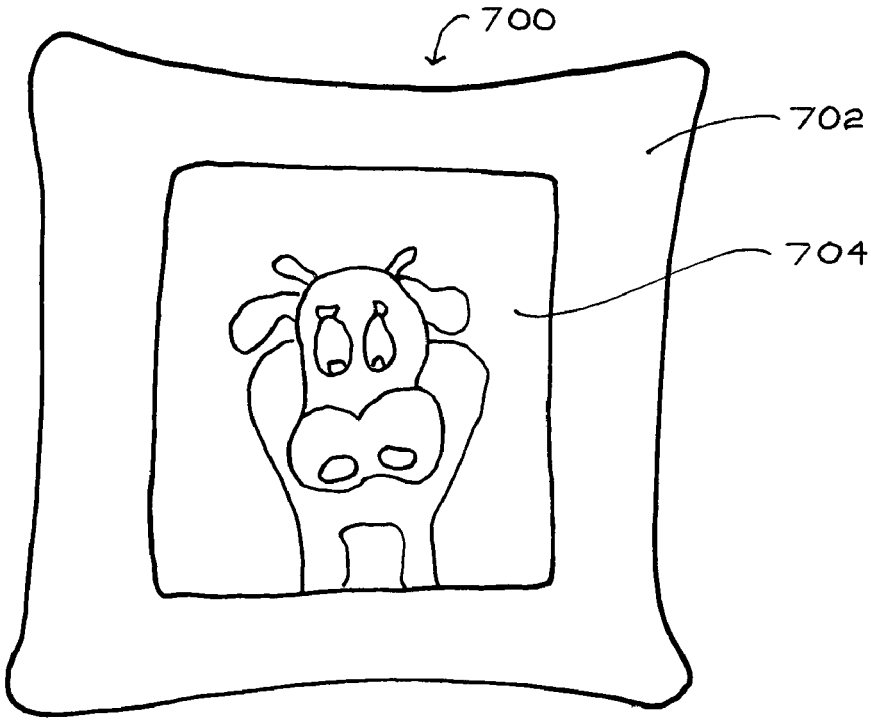
FIG. 7A is a front view of a pillow of an alternative embodiment.
Figure 7B:
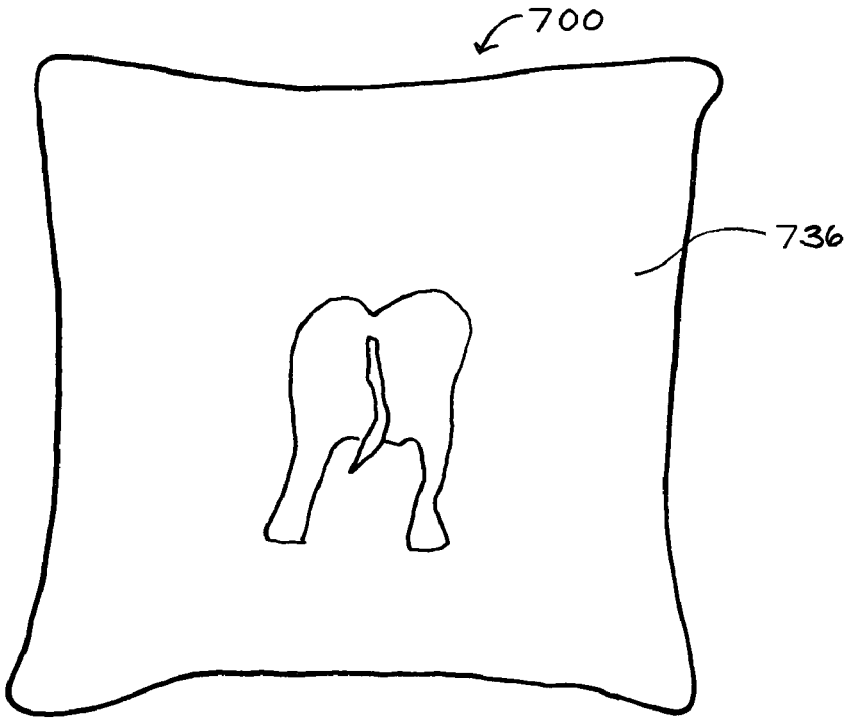
FIG. 7B is a back view of the pillow of FIG. 7A.
Figure 7C:
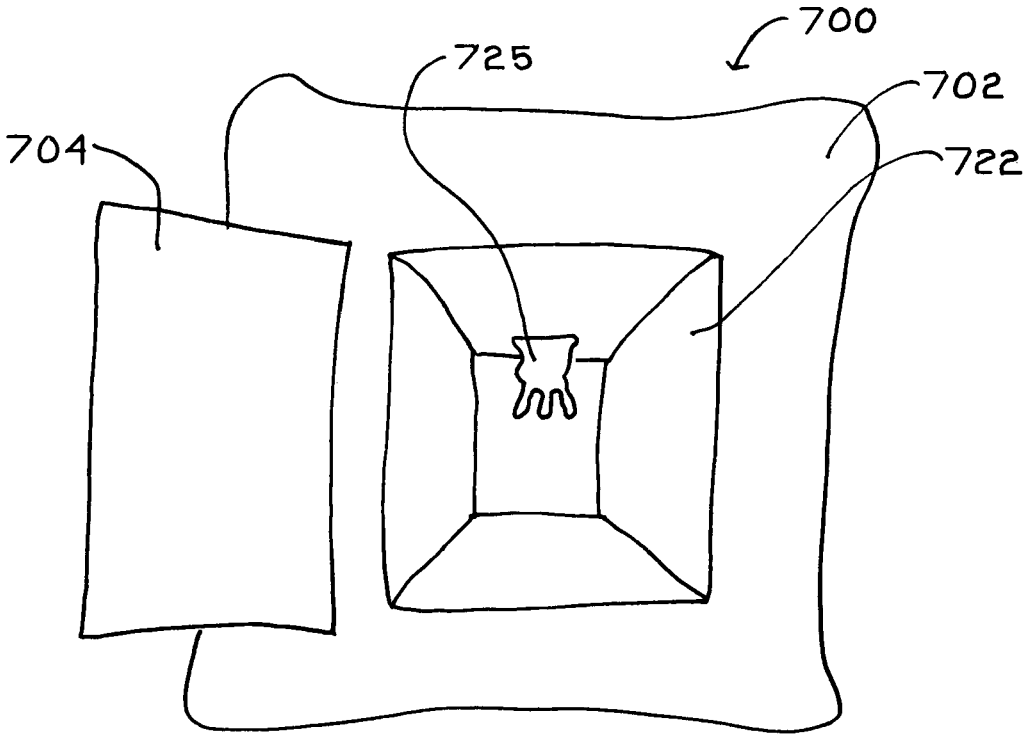
FIG. 7C is a front view of the pillow of FIG. 7A with a door open.
Figure 8:
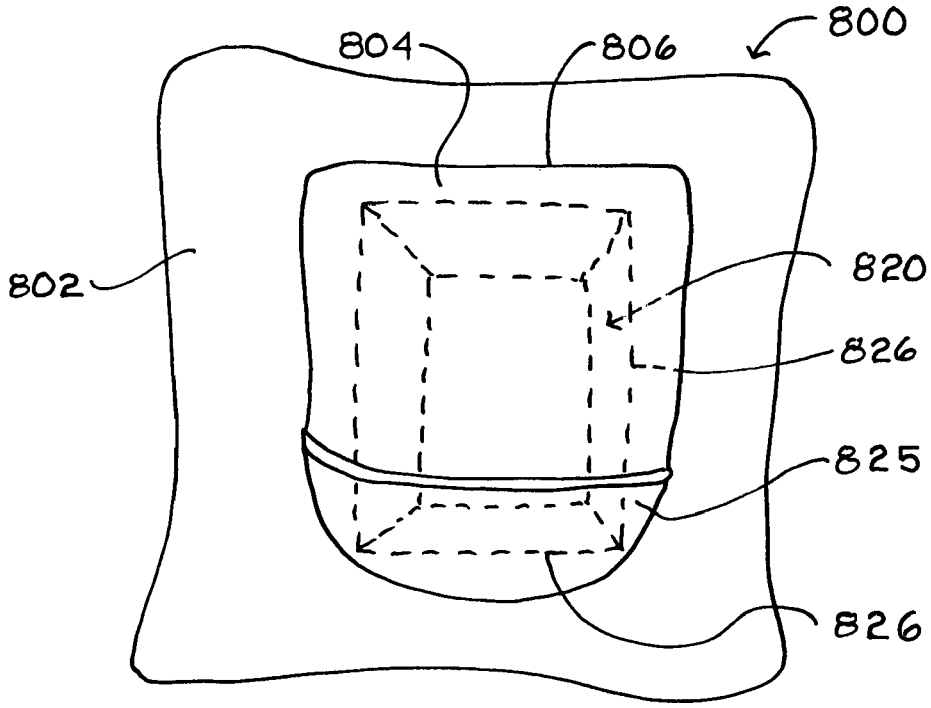
FIG. 8 is a front view of another embodiment shown with the door closed.
Figure 9:
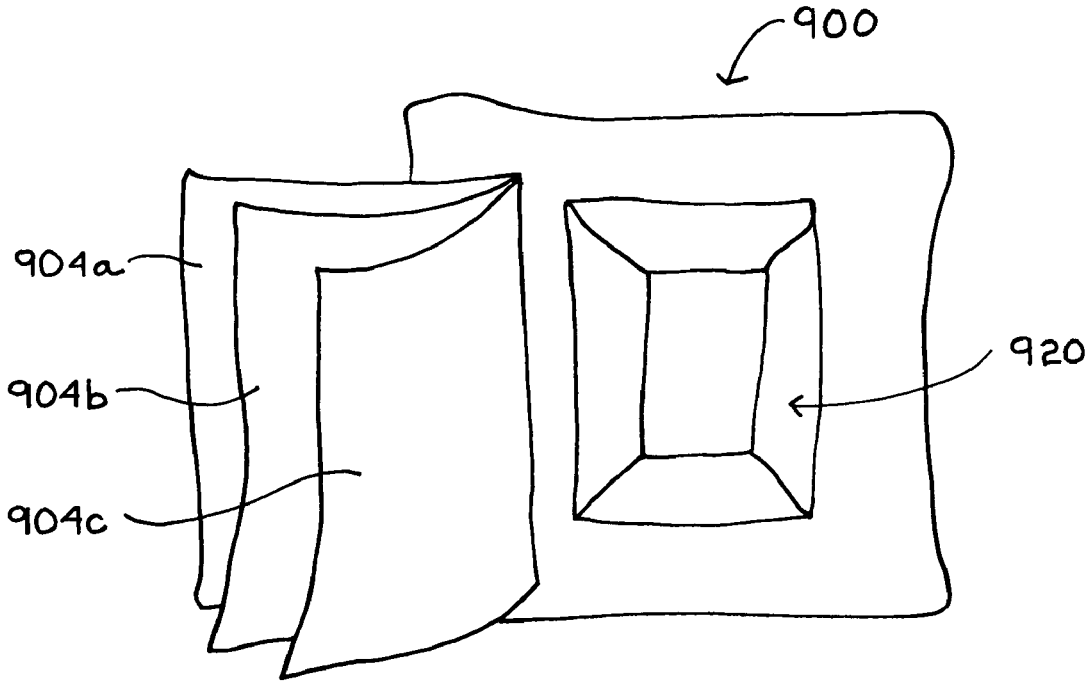
FIG. 9 is a front view of another embodiment shown with the door open and the door comprising multiple leaves.
Figure 10:
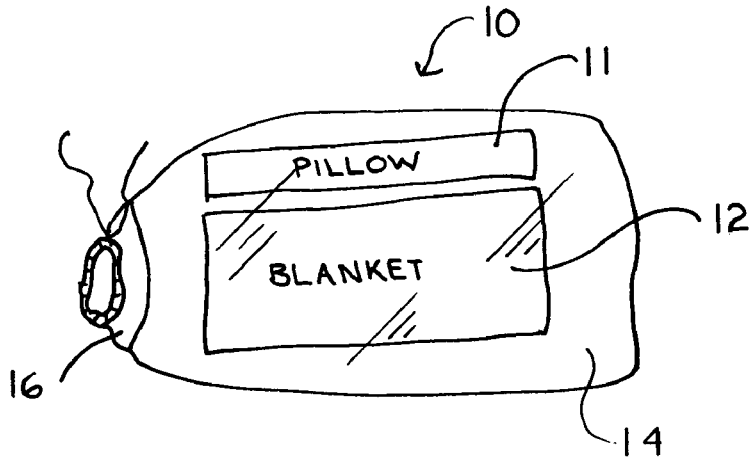
FIG. 10 is a side view of a pillow kit.

Referring now to the drawings, the present play pillow article with hiding cavity is as illustrated in the various embodiments of FIGS. 1-10. In the preferred embodiment of FIGS. 1A-1H, the pillow article is designated generally as pillow 100. FIG. 2 shows and alternative embodiment of the pillow and is designated as pillow 200. FIGS. 3A-3B show yet another embodiment of the pillow designated as pillow 300. FIGS. 4A-4E show another embodiment of the pillow designated as pillow 400. FIGS. 5A-5G show another embodiment of the pillow designated as pillow 500. FIGS. 6A-6E show another embodiment of the pillow designated as pillow 600. FIGS. 7A-7B show another embodiment of the pillow designated as pillow 700. FIG. 8 shows another embodiment of the pillow designated as pillow 800. FIG. 9 shows another embodiment of the pillow designated as pillow 900. FIG. 10 shows a kit including a pillow, a blanket and a container.

Referring now to the preferred embodiment of FIGS. 1A-1G. The present pillow has at least one cavity that is concealed by at least one door. An item such as a stuffed animal or toy that is appealing to children is placed inside the at least one cavity. The cavity is sized to hold the stuffed animal or toy. In further detail, the inventive play pillow article with hiding space is shown as a pillow 100. Pillow 100 comprises a front surface 102 and door 104. Door 104 is pivotally connected to front surface 102 at pivot connection 106. Optional trim 108 encircles pillow 100 at an outline perimeter 110. Trim 108 can be welting or seam tape to facilitate assembly of pillow 100 or can be decorative. Door 104 has a front surface 114 and is shown with optional trim 112.

FIG. 1B shows door 104 partially open, and FIG. 1C shows door 104 in a fully open position where a back surface 116 of door 104 is showing and where cavity 120 is revealed. Cavity 120 has a sidewall perimeter surface 122 encircling cavity 120. Cavity 120 also has a floor surface 124. Floor surface 124 appears smaller in FIGS. 1B and 1C (and in the other figures showing cavities of the present invention) because sidewall perimeter surface 122 billows inward to the cavity. The billowing sidewall perimeter surface 122 serves to frictional yet releaseably hold an item in cavity 120. The billowing inward can also be seen in FIG. 1G. Cavity floor surface 124 can be the size of opening 126 as shown or vary up to about an inch in any direction and still appear uniform due to the billowing of sidewall perimeter 122. Cavity sidewall perimeter surface 122 tends to crease against itself at corners of the cavity (shown as diagonal lines into the cavity) when made of one piece of fabric.

A back surface 116 of door 104 may have a pouch 117 attached that is shown as transparent pouch for holding a picture of a loved one. Pouch 117 could alternatively hold a book or the like and need not be transparent. The pouch could be located elsewhere on pillow 100 including within the cavity on the floor or sidewall, or on other surfaces of the pillow. Additionally or alternatively, the door or other part of the pillow may be personalized by being monogrammed or using photo fabric. Text indicia could further indicate the theme of the pillow, for example, a poem or even a single word that is suggestive of the pillow theme.

A sound device 119 may be inserted in the pillow such that it activates when the door is opened, when the pillow is pressed near the sound device, or when the pillow is shaken or the like. It is appreciated that sound device may be in or on the pillow in other locations. The sound emitted from the sound device can further enhance and illustrate the pillow theme. For example, a cow theme pillow could emit a "mooo" sound, or a pillow theme suitable for babies could be accompanied by a lullaby sound.

FIG. 1C shows a stuffed bear 128 as an example of an item being removeably placed into pillow cavity 120. Once an item 128 is placed in cavity 120, door 104 can be pivotally rotated about pivot 106 from open position 132 to close to a closed position 130. Door 104 is larger than cavity opening 126 and overlaps a portion of front surface 102 around cavity opening 126. In a preferred embodiment an area encircled by cavity opening 126 is about twenty-three percent or more of a front view surface area of the pillow which is encircled by outer perimeter 110. For example, when the pillow outer perimeter is about thirteen inches by thirteen inches and the cavity opening is about five and three-quarters inches by six and three-quarters inches, the frontal area is about 169 inches square and the cavity opening area is about 39 inches square, 39 being about twenty-three percent of 169. In some other embodiments, the cavity opening area is generally about eighteen percent or greater of the frontal area. The relative areas vary due to various seam allowances, whether welting is added or not, and stretch due to cushioning medium pushing at the pillow layers. A securing means 134 is used to releaseably secure door 104 in closed position 130. Securing means 134 is shown as one or more hook and loop fastener pieces, but may be other means of securing, such as, magnets, button and button hole, tie string, lever, notch and catch, zipper, snap, sticky substance, lever, pad lock, rope or means that help children develop motor skills. Alternatively, the securing means could include a spring action that works in conjunction with pivot 106 to bias door 104 to the closed position.

A theme of the pillow is visually illustrated by the combination of the item and indicia on the pillow. FIG. 1C shows item 128 representing bear and indicia 131 representing a tree. Indicia 131 is a fabric repeat pattern which suggests a plurality of trees of a forest such that the theme is a bear in the woods. Cavity sidewall perimeter surface 122 and door 104 may have a similar pattern or have forest green indicia for example. Preferably the pillow is made soft by using fabric and more specifically quilted fabric, that is, fabric quilted to batting material. The quilting pattern can further illustrate the pillow theme, for example, a tree pattern could be quilted. It is appreciated that other materials could be used including natural or synthetic such as fur, felt, leather, fleece, plastic, or natural fiber. These materials could be selected to further illustrate the pillow theme, for example, fur or felt for the bear in the woods theme, or leather for a western theme.

FIG. 1D shows back surface 136 of pillow 100 bearing an identification label 138. The dotted line 150 will be explained later in further detail but it refers to a floor of the cavity. FIG. 1E shows a perspective bottom side view and FIG. 1F shows a perspective right side view showing a pillow depth similar to a typical throw pillow. Note, the drawings are not to scale and relative proportions may vary. Also, directions such as front, back, top, bottom, right, left are used for orientation during explanation but do not necessarily reflect how the present invention will ultimately be used.

FIG. 1G shows a cross-sectional view taken along line 1G-1G in FIG. 1A. A front layer 140 bears front surface 102, cavity sidewall perimeter surface 122 and cavity floor surface 124 which together form a first surface. Front layer 140 comprises three layers including outer front layer 142, cavity sidewall perimeter layer 144 and cavity floor layer 146. Back layer 148 bears exterior back surface 136 and interior back surface 137. The dotted line 150 shown in FIG. 1D can be stitching at the perimeter of floor layer 146 used to hold floor layer 146 to interior back surface 137. It is appreciated that floor layer 146 may be spaced from or bonded to interior back surface 137, in which case dotted line 150 is a hidden line representing the perimeter of floor layer 146.

FIG. 1G also shows pillow 100 filled with cushioning medium 152. Cushioning medium 152 is contained in between front layer 140 and back layer 148, which together form a cushioning member. Cushioning medium 152 causes cavity sidewall perimeter surface 122 to billow inward to cavity 120. Cushioning medium 152 may comprise a variety of cushioning mediums such as but not limited to polyester, synthetic fiber, cotton, natural fiber, batting, foam, air, feathers, foam and fiber fill combination or any other medium or combination.

FIG. 1H shows an alternative embodiment similar to pillow 100, but has a hidden cavity within a cavity. Cavity 120 has a cavity floor surface 124*s* that has an opening 126*s* and a door 104*s* for concealing and revealing a second cavity 120*s*.

A method of making pillow 100 of the preferred embodiment is as follows. A piece of durable, washable fabric approximately forty-four inches wide and twenty-four inches in length is selected in which the layers of the pillow may be cut from. The size can vary based on the desired pillow size and on the fabric pattern repeat. Generally, a fabric print is selected that bears indicia of the intended type or style of stuffed animal, doll, or toy, which will be placed inside the pillow cavity. The fabric may also be selected to match a desired piece of furniture or may be a popular "Gingham"™ chex print, for example. The fabric piece is generally quilted in a meandering type of pattern to provide an extra soft pillow and texturally interesting pillow. The quilted fabric comprises the selected fabric and polyester or cotton batting and a backing of cotton or cotton blend fabric quilted together. Contrasting fabric can be selected for making door trim 112 and for making outline perimeter trim 108; these trims may be referred to as binding, welting or cording. For example, cotton piping cording or welt may be used for making door trim 112 and for perimeter trim 108. Although perimeter trim 108 may be larger, for example, approximately two inches wide and thirty-three inches in length.

Conventional cutting and sewing methods are used to construct pillow door 104. Two pieces of quilted fabric, generally rectangular in shape and about eight inches by eight and one-half inches are cut out of the selected fabric for pillow door 104. Two pieces of hook and loop fastener tape, approximately ⅝ inch by ⅝ inch, are sewn onto a back surface of the quilted fabric at the top edge and bottom edge approximately one-half inch in from the corner edges. To make trim 112, a bias strip of coordinated or matching fabric measuring approximately two inches wide and fifty-six inches in length is folded over a piece of cording, which is approximately 8/32 of an inch in diameter, and sewn over the cording by using a welt attachment foot. When trim 112 is made in this manner it is called piping.

The piping is sewn onto the right side of the door. The door front panel of fabric and door back panel of fabric are then placed right sides together and sewn along piping by using a welt attachment foot, leaving about three inches gap for turning door inside out. The gap and piping is then finished by hand sewing, but it may be done by a machine.

Preparation of pillow front layer 140 is as follows. A piece of quilted fabric that is thirteen inches by thirteen inches is cut from the selected fabric. A mark is made on a wrong side of the pillow front to designate the top of the pillow front. By using a template, a cavity opening, the size of which is approximately five and one-half inches by six inches, is marked for cutting onto the interior or wrong side of the pillow front. The cavity opening is then cut out with scissors.

Cavity sidewall perimeter layer 144 is about twenty-four inches long and five and one-half inches wide is cut from the selected fabric. Next, the five and one-half inch ends of the cavity sidewall perimeter layer are joined together. Cavity sidewall perimeter layer is then joined to outer front layer 142 by folding right sides together and joining. With the right side of cavity sidewall perimeter layer 144 and outer front layer 142 placed together, cavity sidewall perimeter layer 144 is sewn around cavity opening to form cavity opening 126 surrounded by the pillow front outer layer 142.

Door 104 is pivotally attached to pillow front surface 102 in the following manner. Pillow door 104 is laid over the center of cavity opening 126 with back surface 116 of door 104 placed against the right side of front surface 102 and joined to the left side by stitching closely beside or at door trim 112.

The stitching forms pivot 106 in which door 104 can pivot between open position 132 and closed position 130. In alternative embodiments, door 104 could be attached along a right side, top side, or bottom side or other. Further, pivot 106 could be formed other than by stitching such as but not limited to bonding or welding. Hook and loop fasteners 134 are stitched onto a right side of pillow front surface 102 to mate with hook and loop fasteners 134 attached to door 104.

Perimeter trim 108 prepared by folding a two inch wide bias fabric strips over cotton piping cording or similar type. Trim 108 is joined to a right side of pillow front layer 140 starting at the bottom edge and encircling the pillow. When both ends meet, the ends are joined together by cutting the trim approximately two inches beyond where both ends meet. The trim fabric is separated from the cording on the extra length and the cording is cut to abut both ends together and the excess fabric is folded around both ends to provide a finished edge and stitched.

The pillow back layer 148 is prepared by gluing cavity floor layer 146, which is about five and one-half inches by seven and one-half inches, to the wrong side of pillow back layer 148 on interior back surface 137 and generally at the center thereof. Cavity floor layer 146 can be a piece of the quilted fabric. An identification label which may include trademark, copyright and patent information is stitched to a bottom right side of the pillow back layer 148 at approximately one inch from both corner edges.

Finally, pillow front layer 140 and pillow back layer 148 are placed right sides together and stitched by using an industrial sewing machine equipped with welt foot. An approximately four inch gap is left open for turning the pillow layers right side out. After the pillow layers are turned right side out, cavity sidewall perimeter layer 144 is joined to back layer 148 by tucking approximately a one-half inch seam allowance underneath folded back edges of the cavity floor layer and stitching along perimeter edges of the cavity floor layer. The resultant pillow shell 145 is then stuffed with cushioning medium 152 and the remaining four inch opening is closed such as by hand needle and thread. Shell 145 and cushioning medium 152 together form a cushioning member with door 104 being attached thereto. An item such as stuffed animal or toy 128 is then placed inside the pillow. The pillow can then be package for shipment or assembled into a kit including a matching theme blanket and container.

In use, as discussed above, pillow 100 can improve a child's motor skills and stimulate imagination while providing quiet time entertainment with a soft, non-breakable article. For adults, the pillow is intriguing because it can appear to be a typical throw pillow, yet appear to have a door which cleverly creates a since of mystery that entices a person to open the door revealing the hidden cavity and it's surprising contents.

FIG. 2 shows an alternative embodiment of a pillow which has a hidden cavity and a structure. More specifically, pillow 200 has a cavity 220 with an opening 226 which is encircled by front surface 202. Cavity 220 has sidewall perimeter surface 222 and a floor surface 224. Door 204 is shown folded over about pivot 206 to an open position 232 but can close to a closed position to conceal cavity 220 and items 228. Items 228 are shown as a stuffed cowboy and a stuffed horse positioned behind a structure 225. Structure 225 is assembled of bar members representing a log fence. Structure 225 can serve to illustrate the pillow theme, here a western theme, and hold items 228 in cavity 220. Structure 225 bridges cavity 220 and is attached to cavity sidewall perimeter surface 222 at right, left and bottom sides thereof. Structure 225 and is made of fabric with cushioning medium therein to contribute to the overall softness of the pillow. It is appreciated that other materials could be used to form the structure and the structure could be attached to opening 226 or to front surface 202 to provide an alternate appearance. While a corral like log fence appropriately matches the cowboy and horse western theme, other bar members such as a jail bar members or window bar members may be suitable to illustrate another theme of the pillow. Further, the pillow material may have at least a portion that is leather to illustrate the western theme, or may include lasso rope appliqued on a surface or quilted. Still further, the structure bridging the cavity could be more organic in nature such as being tree like, and may bridge only a portion of the cavity.

Figure 3A:
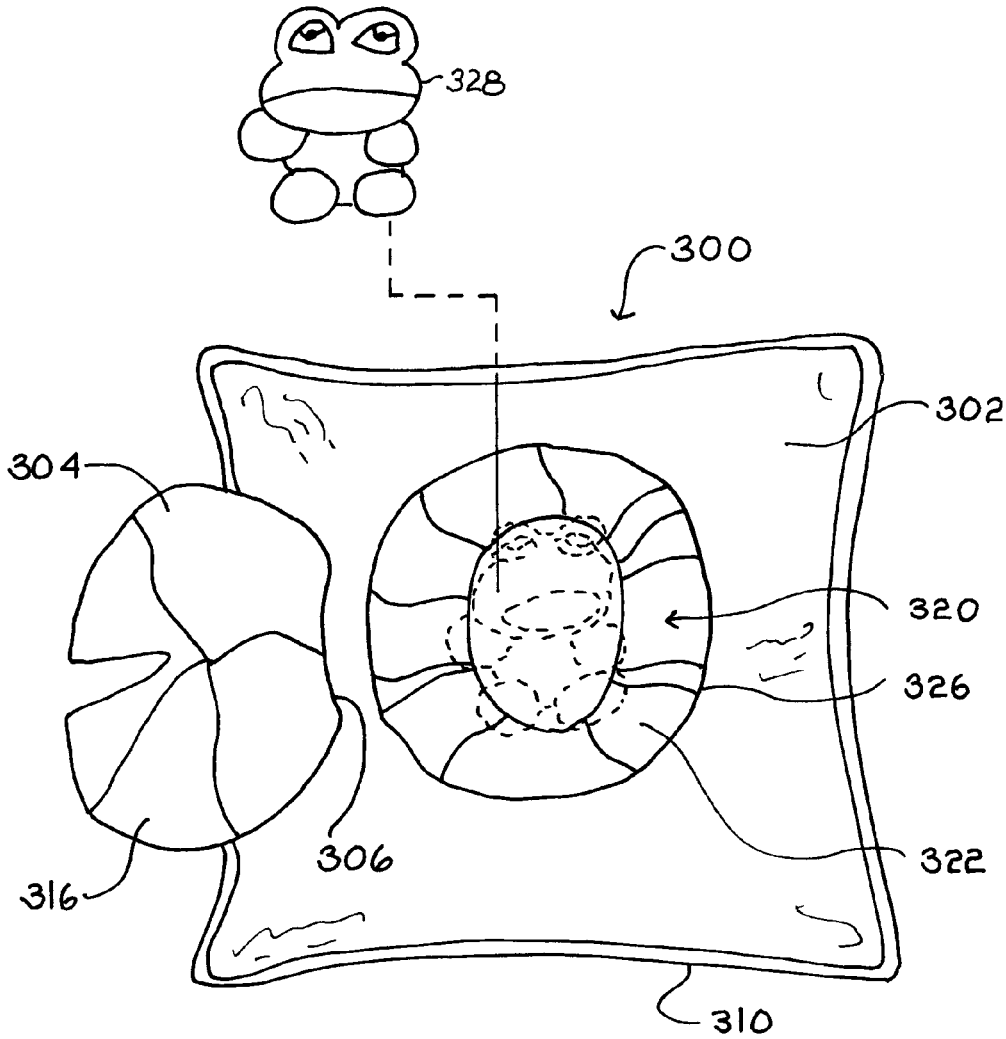
FIG. 3A is front view of a pillow of another embodiment with a door in an open position.
Figure 3B:
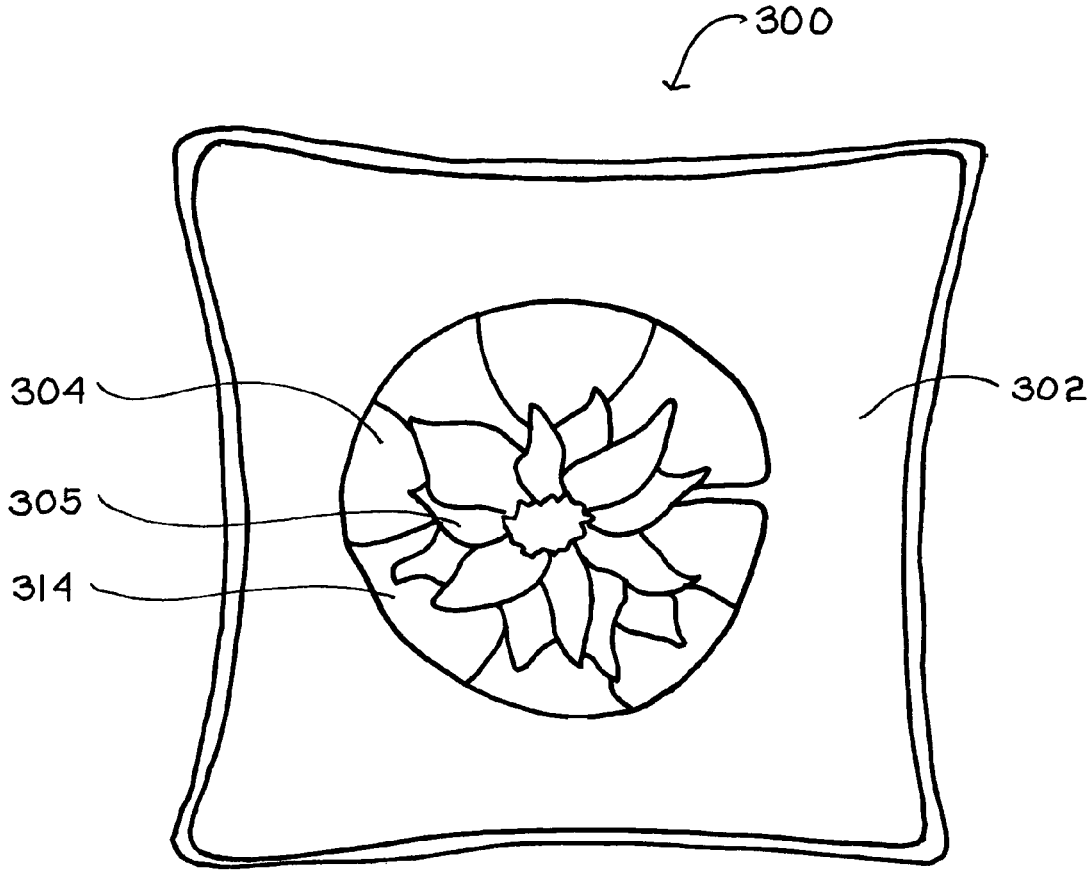
FIG. 3B is a front view of the pillow in FIG. 3A with the door in a closed position.

Referring now to FIGS. 3A and 3B, another embodiment is shown as pillow 300. In this embodiment, pillow 300 depicts a frog theme where a frog item 328 is hidden in a cavity 320 underneath a lily pad shaped door 304. Pillow 300 may have a generally square perimeter outline 310 like a traditional throw pillow as shown, or may have a circular outline further illustrating the frog and lily pad theme. Cavity 320 is circular having circular opening 326 and a perimeter sidewall surface 322 which encircles cavity 320. The lines shown on the perimeter sidewall 322 are fabric creases where fabric overlaps itself, although it is appreciated that other material could be used which may not lend itself to creasing. Cavity 320 also has floor surface 324 which is round and is generally similarly sized to opening 326 but appears smaller in FIG. 3A because perimeter sidewall surface 322 billows inward into cavity 320. Door 304 is in the open position in FIG. 3A and in the closed position in FIG. 3B. Door 304 represents a lily pad with a flower 305 attached to front door surface 314. The back surface 316 of door 304 may have a quilted pattern (shown) or other artistic feature to enhance the look of the back side of the lily pad door. Top surface 302 and/or cavity sidewall perimeter surface 322 may have blue indicia and quilted water waves indicia to illustrate water, the door 304 may have green indicia to represent a lily pad, and the flower 305 may be white like a lily pad flower, together the indicia and shapes visually illustrate the frog theme. In an alternative embodiment, front surface 302 may have frog indicia, such as a fabric with jumping frogs, which would also visually illustrate the frog theme. It is appreciated that other theme are suitable for round cavity pillows, such as nests or burrowing animals.

FIGS. 4A-4D show another embodiment as pillow 400. In this embodiment, pillow 400 depicts a space ship theme where a space creature or a spaceman may be hidden in cavity 420. Pillow 400 includes a first door 404 and a second or cover door 454. Second door 454 suggests a portal in the space ship. In addition, perimeter outline 410 is shaped to represent a space ship. The material used to make pillow 400 is chosen with indicia that represents an outer space or space ship theme, such as a planet or star pattern or astronaut pattern. A "Toy Story"™ movie theme such as "Buzz Lightyear"™ with a space ship may also be appropriate.

Figure 4A:
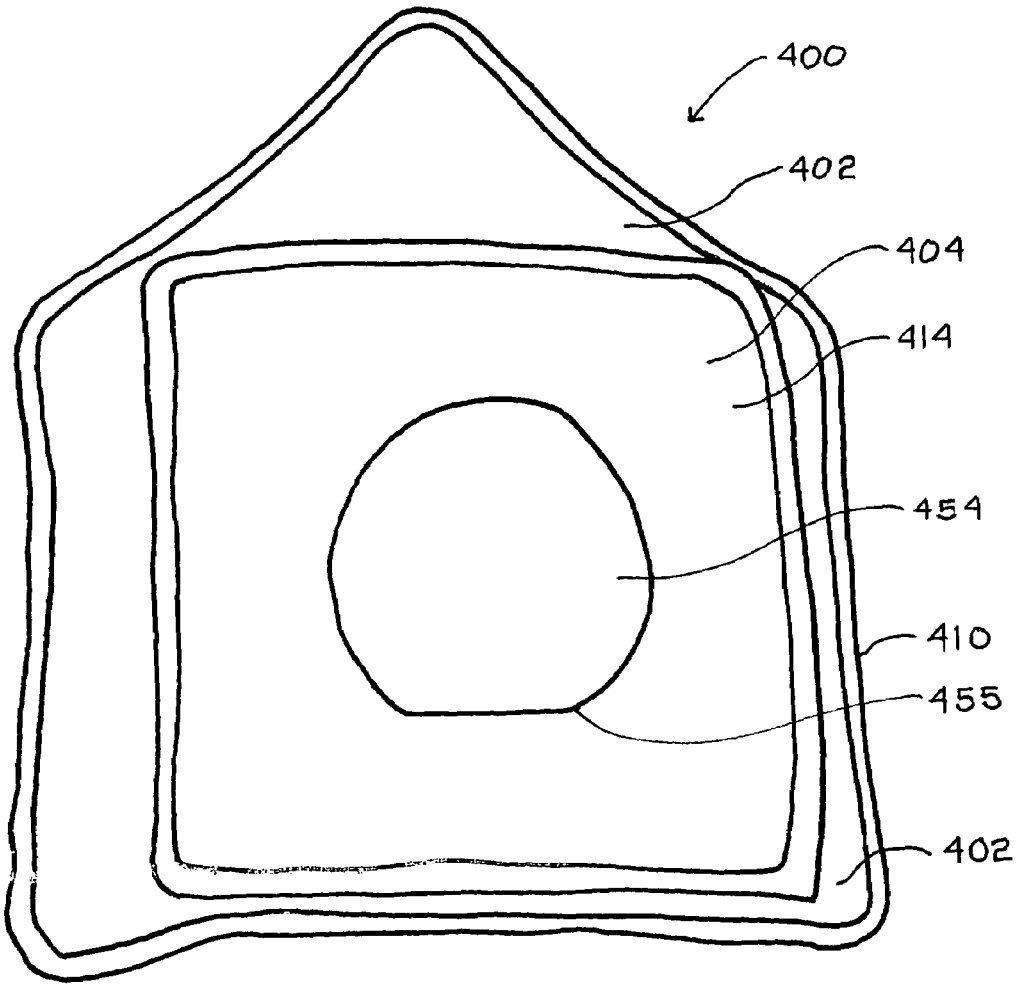
FIG. 4A is a front view of a pillow of another embodiment with doors in closed positions.
Figure 4B:
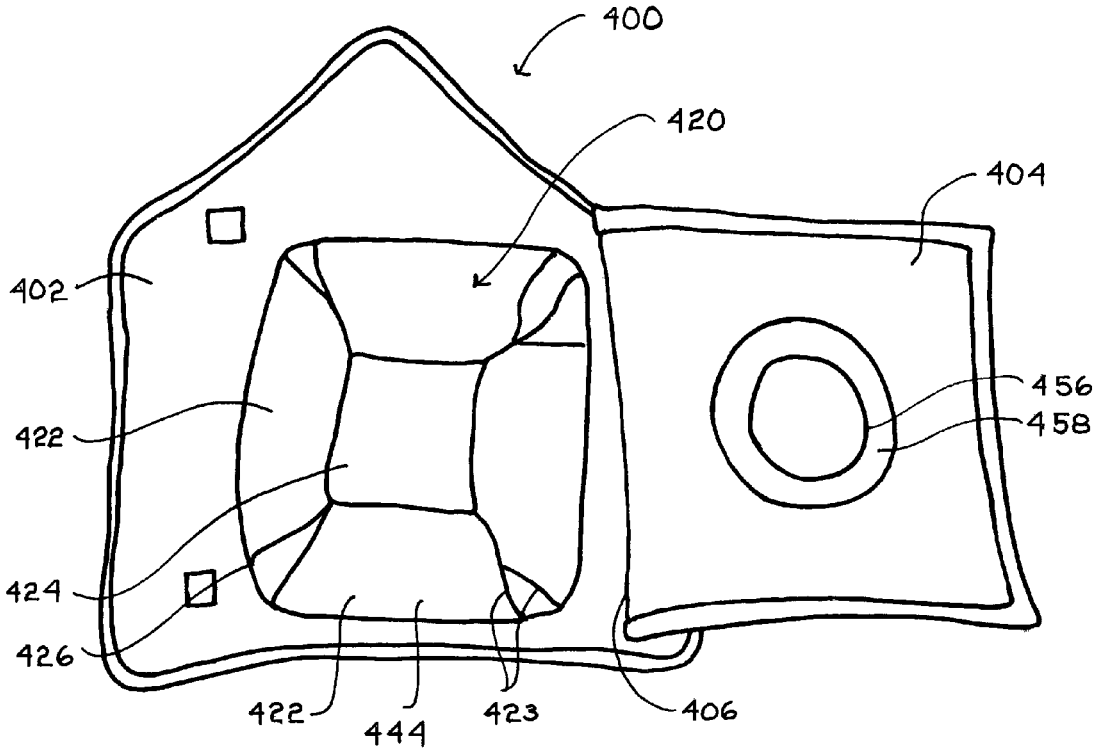
FIG. 4B is a front view of the pillow of FIG. 4A showing one door in an open position.
Figure 4C:
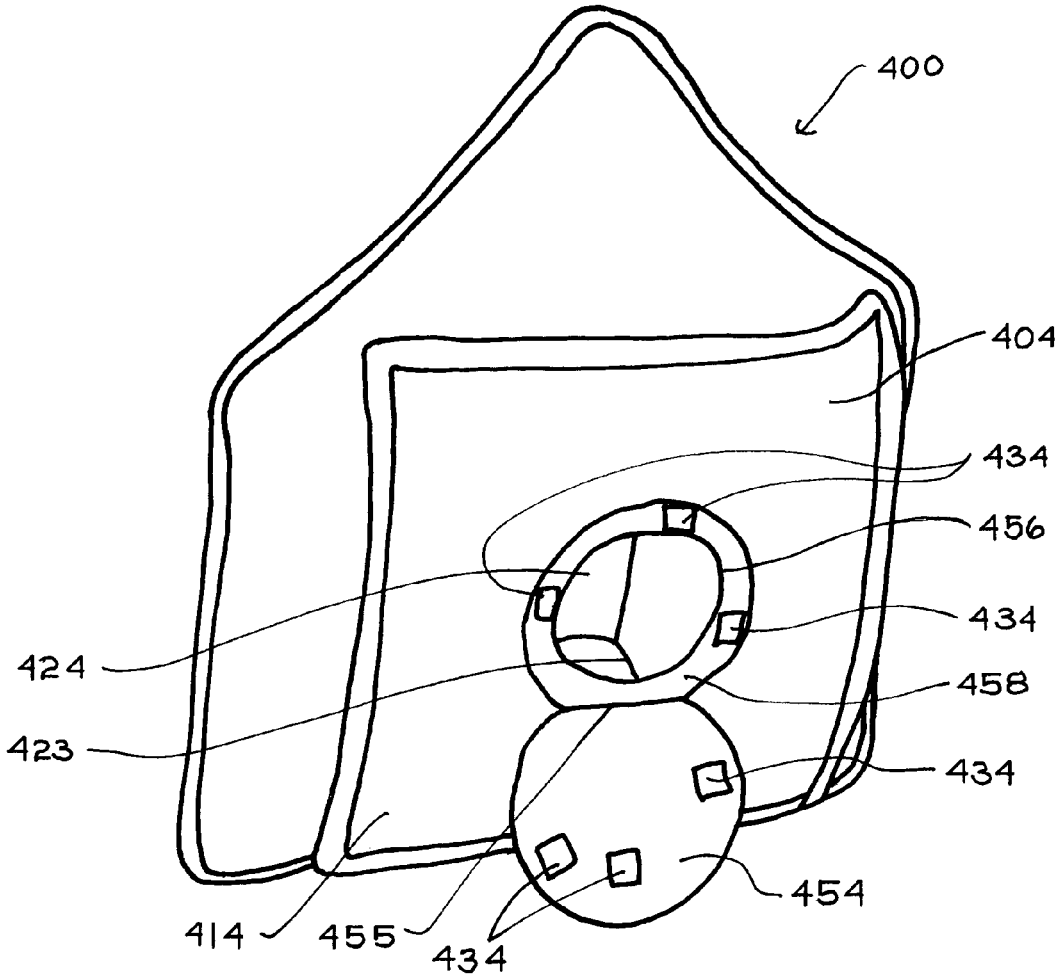
FIG. 4C is a front perspective view of the pillow of FIG. 4A with another door in an open position.
Figure 4D:
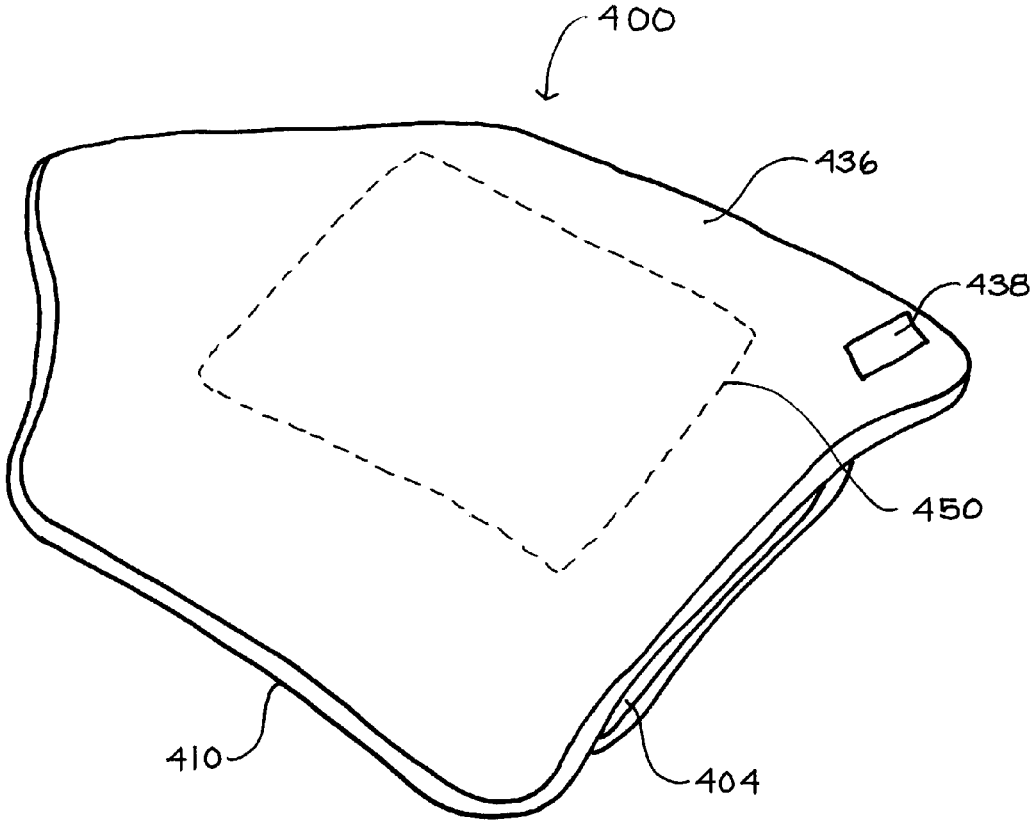
FIG. 4D is a back perspective view of the pillow of FIG. 4A.

In further detail, pillow 400 has a first door 404 which has a door opening 456 edged by an optional trim 458. Securing means 434 is shown as pieces hook and loop material but may be other means as discussed above with respect to securing means 134. Securing means 434 is positioned on trim 458 and thus concealed by second door 454 when the second door in a closed position, see FIGS. 4A and 4C. Second door 454 is connected to front surface 414 of first door 404 so as to pivotally open along pivot 455. First door 404 is connected to front surface 402 so as to pivotally open along pivot 406. Similar to pivot 106, pivots 455 and 406 may be stitched lines, for example, or other as discussed. Also similar to the previous figures, cavity 420 is encircled by a cavity sidewall perimeter surface 422. Cavity sidewall perimeter surface is shown as a fabric layer 444 having creases 423 at cavity corner areas. Cavity floor surface 424 can be sized as shown or can be sized similar to cavity opening 426 in which case sidewall perimeter surface billows inward obscuring a portion of floor surface 424 yet providing a snug fit for an item placed in cavity 420. The billow is generally due to cushioning medium inside of the pillow shell (note shell 145 of FIG. 1G). FIG. 4D shows back surface 436 having perimeter outline 410 generally in the shape of a space ship, and having an identification label 438. Dotted line 450 is the outer perimeter of floor surface 424 as seen through back surface 436, or alternatively, dotted line 450 is stitching where a cavity floor layer is attached to an interior surface of the back layer (layers not shown, refer to FIGS. 1D and 1G).

FIGS. 5A-5G show another embodiment as pillow 500. In this embodiment pillow 500 depicts a barn theme. Animals or farmer dolls or the like may be hidden in cavity 520*a* and revealed by opening a barn door. The barn door is shown to comprise a pair of doors 504*a-b* which open in opposite directions. Barn pillow 500 is also shown to have third door 504*c* which represents a barn stall hidden behind the pair of doors. A second cavity 520*b* is also shown which does not have door. In this embodiment, an outer perimeter sidewall 560 is added to provide depth to the pillow.

Figure 5A:
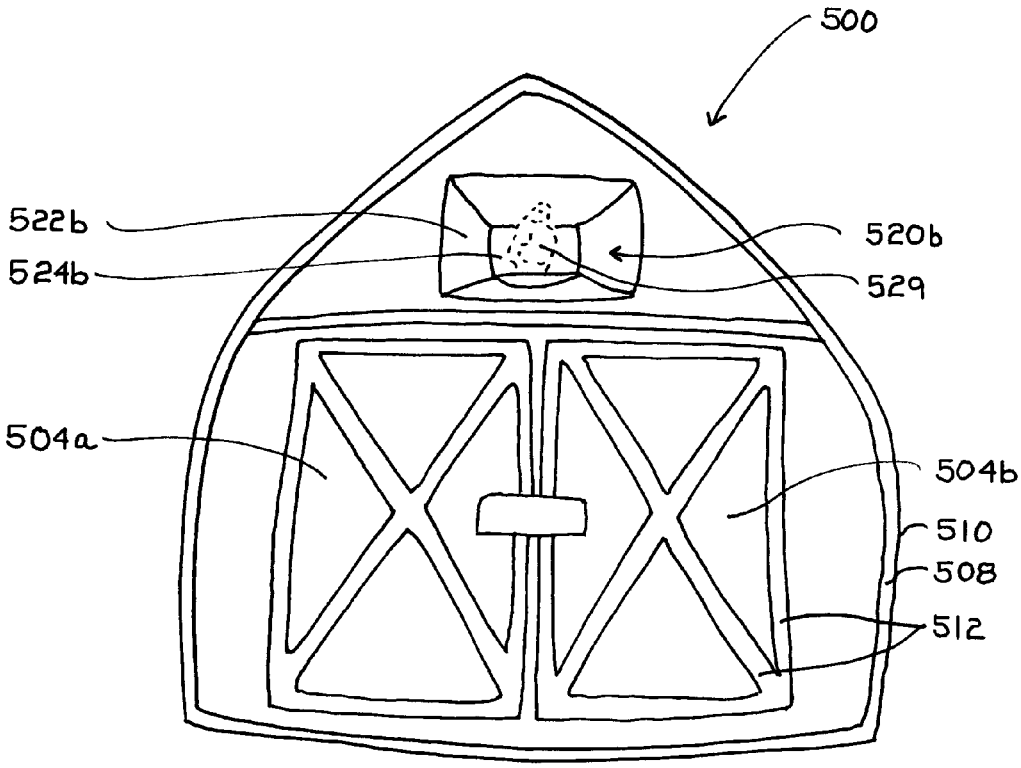
FIG. 5A is a front view of a pillow of another embodiment having more than one door in a closed position.
Figure 5B:
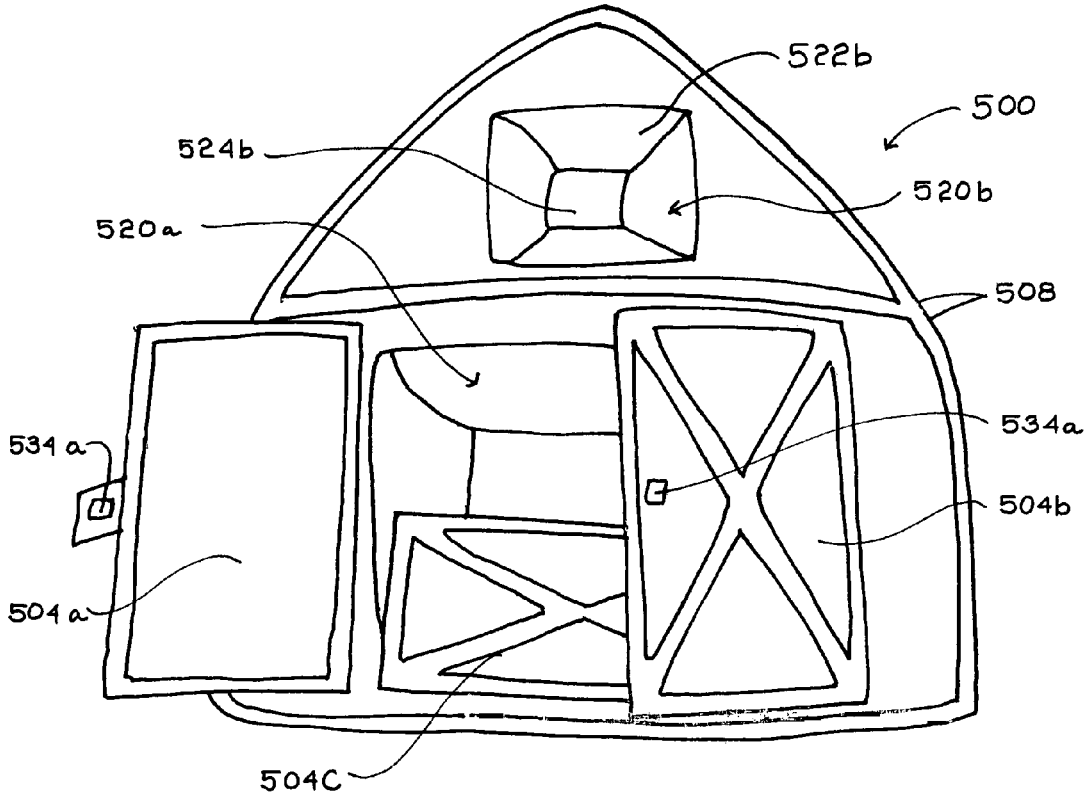
FIG. 5B is a front view of the pillow of FIG. 5A with one door in an open position.
Figure 5C:
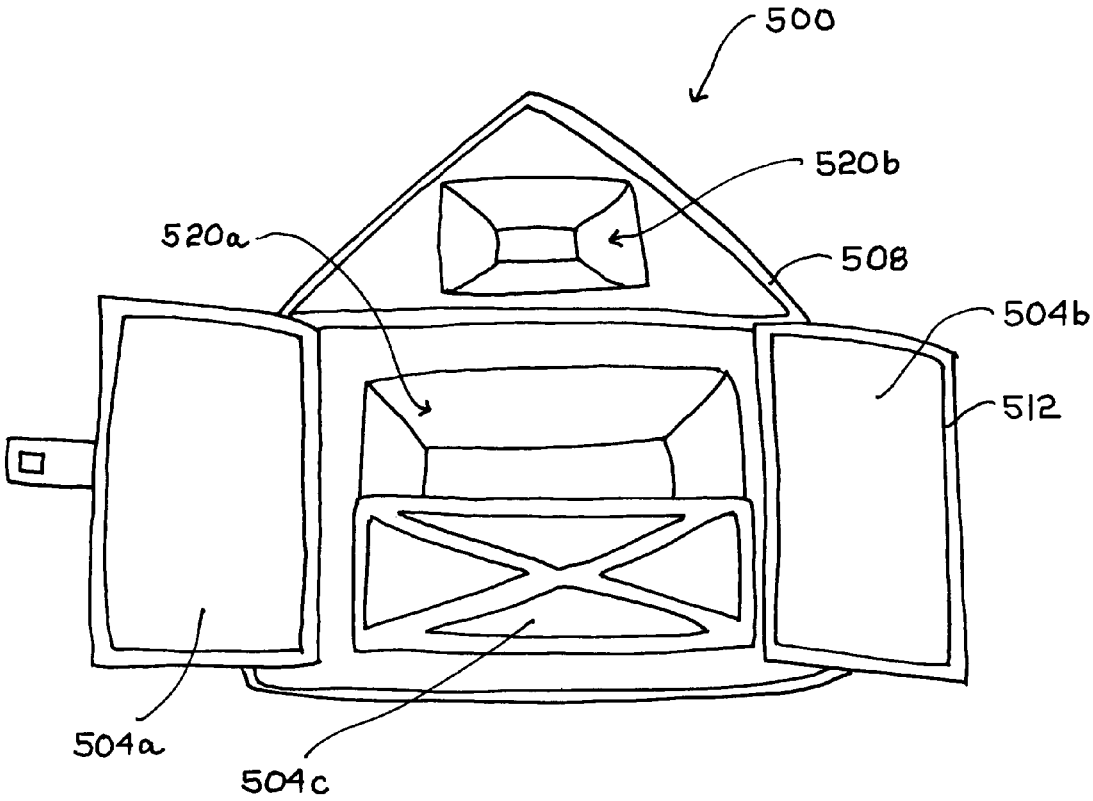
FIG. 5C is a front view of the pillow of FIG. 5A with two doors in open positions.
Figure 5D:
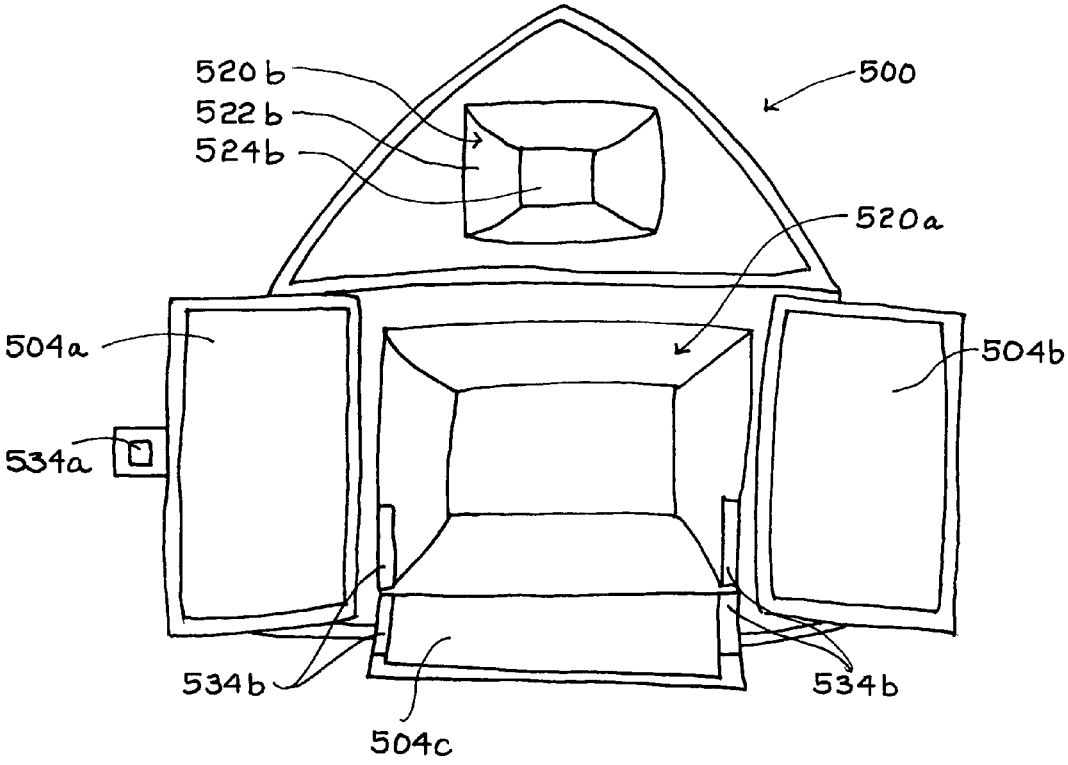
FIG. 5D is a front view of the pillow of FIG. 5A with three doors in open positions.

More specifically, pillow 500 has an outline perimeter 510 generally in the shape of a barn building for illustrating a barn theme. A dog house building theme may have a similar perimeter outline. Pillow 500 has a first door 504*a* and a second door 504*b* which in a closed position as shown in FIG. 5A conceal cavity 520*a*, and open in opposite directions to open positions to reveal cavity 520*a*. A third door 504*c* conceals a portion of cavity 520*a* when in a closed position, and opens downwardly to an open position, as shown in FIG. 5D. Third door 504*c* represents a barn stall and serves to hold animals or other items in cavity 520*a*.

Cavity 520*a* is as described in the previous embodiments with a cavity sidewall perimeter surface and a floor surface (not labeled). A securing means 534*a* is shown as a hook and loop piece on a tab that resembles a latch on barn like door 504*a*, and a mating piece of hook and loop is on door 504*b*. Additional securing means 534*b* can be used to hold third door 504*c* in place. The securing means is as described in previous embodiments above. Trim 508 accents pillow 500 as does trim 512 which accents the doors. Pillow 500 preferably has red indicia with white indicia trim so as to further illustrate the barn theme. A second cavity 520*b* suggests a loft in the barn. Cavity 520*b* is similar to the previous cavities but does not necessarily have a door. Cavity 520*b* has a cavity sidewall perimeter surface 522*b* and a floor surface 524*b* and is shown in FIG. 5A with a chicken item 529 positioned in the cavity.

Figure 5E:
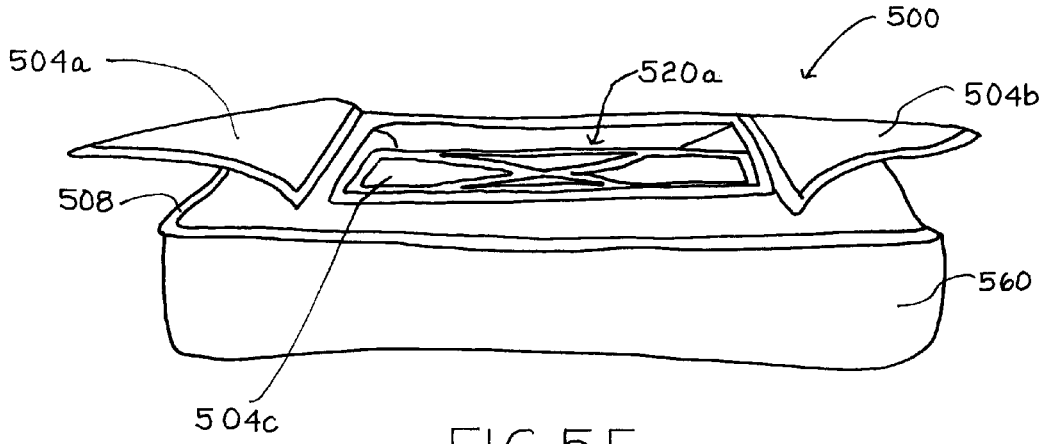
FIG. 5E is a bottom perspective view of the pillow shown in FIG. 5C.
Figure 5F:
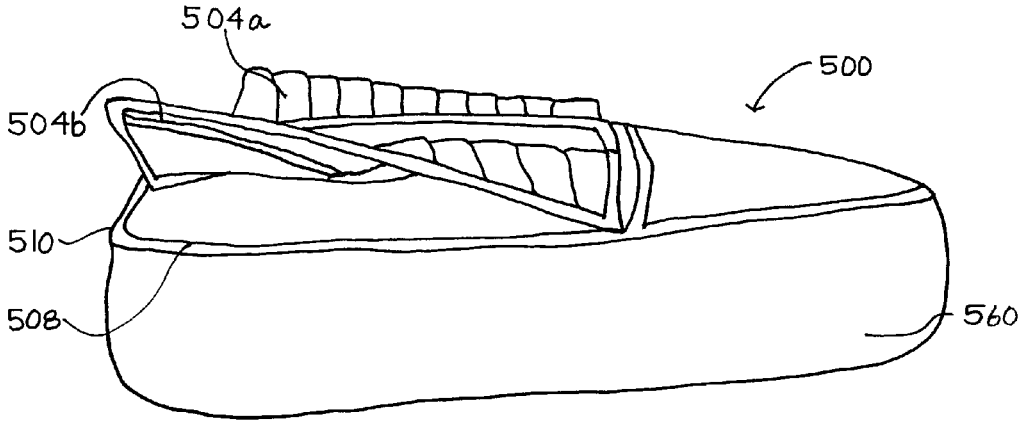
FIG. 5F is right side perspective view of the pillow shown in FIG. 5C.
Figure 5G:
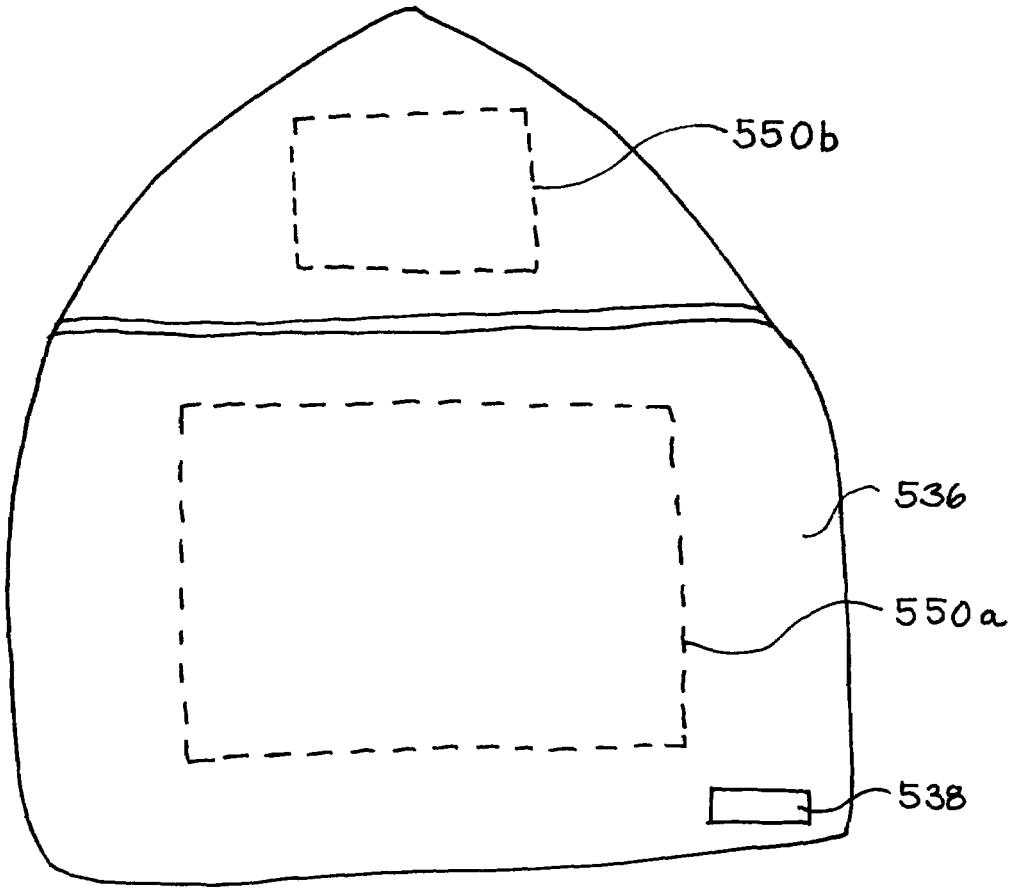
FIG. 5G is a back view of the pillow shown in FIG. 5A.

FIGS. 5E-G show an outline perimeter sidewall 560 which emphasizes the barn shape and provides depth to pillow 500. This depth creates deeper and more uniform cavities closer to the outline of the pillow as compared to the pillows that do not have an outline perimeter sidewall. This allows cavities 520*a* and 520*b* to hold more barn animals or other items. FIG. 5F also shows the use of quilted material for barn door 504*a-b* which further illustrates the barn theme by appearing like boards of the barn. FIG. 5G shows back surface of pillow 500. Back surface 536 can bear an identification label 538 and dotted lines 550*a* and 550*b* may appear as stitching on back surface 536 when the floor layer of cavities 520*a* and 520*b* are sewn to an interior surface of a back layer of pillow 500. As above, alternatively, the dotted lines may be hidden lines indicating the perimeters of respective floor surfaces 524*a* and 524*b*. Attaching the floor layer to the back layer is preferred to prevent the cavity from collapsing or turning inside out. It is appreciated that a floor layer may be bonded to an interior surface of a back layer, or that the back layer may be two sided material, or that a floor surface or floor layer need not extend all the way to the back layer. It is also appreciated that a smaller barn could omit the barn loft cavity 520*b*.

FIGS. 6A-6E show another embodiment as pillow 600. In this embodiment pillow 600 depicts a boat, specifically a pillow that has a religious, Noah's ark theme. Pillow 600 has a plurality of cavities which can hold a plurality of animal items or other items on the ark. Two cavities are on the front of the pillow and two cavities are on the deck in an outer perimeter sidewall. At least one of the cavities has a door to close and conceal items inside the boat. Here, the door conceals animals inside the hull of Noah's ark. This door opens downward to appear like a ramp into the hull of the ark. Two of the cavities can be linked together with an additional tunnel feature that forms a passageway for an item to be passed from one cavity to another. Indicia on the surface of the boat illustrates a boat theme, or an ark theme by being the color of an ark or by having an animal pattern, or quilting pattern such as ark boards, other indicia consistent with the Noah's ark theme.

More specifically, door 604 opens downward like a ramp into the ark and closes to conceal cavity 620*a*. A second cavity 620*b* does not have a door and is shown has having item 628*a* inserted, item 628*a* being a stuffed toy monkey. Both of these cavities are constructed similar to the above embodiments, crease lines are shown in sidewall corners of the cavities but could be seams in material or be smoother with a material that does not tend to crease. Door 604 includes a securing means 634 which is shown as pieces of hook and loop material, but can be as described above with respect to securing means 134.

Front surface 602 comprised a hull portion, a deck portion, a deck cabin portion, and deck cabin awning portion. Front surface 602 is connected to cavity sidewall perimeter surfaces 622*a-b* and cavity floor surfaces 624*a-b*. Trim 608 accents the ark and the deck cabin generally at outline perimeter 610 and also at the starboard and port sides of the boat deck.

An outer perimeter sidewall 660 generally encircles the pillow and provides depth to the pillow which makes the cavity depth more uniform especially as the cavities approach an outer perimeter of the pillow. Outer perimeter sidewall 660 includes two additional cavities, cavity 620*c* and 620*d*, where more items can be stored in pillow 600. FIG. 6A shows two bears 628*b-c* placed respectively in cavities 620*c-d*. These cavities have perimeter sidewall surfaces and floor surfaces (not labeled) similar to the other cavities, except that the floor surface is not necessary connected to an interior surface of a back wall layer. The perimeter sidewall surfaces extend between front surface 102 and back surface 636 and can billow inward into the respective cavities for snuggly holding items.

Pillow 600 has an additional feature and that is a tunnel 662, see FIGS. 6B and 6E. Tunnel 662 forms a passageway between cavity 620*a* and 620*b* so that an item may be passed from within cavity 620*a* to 620*b* and back again. An item can also be partly in a cavity and in tunnel 662 such as shown in FIG. 6A where monkey item 628*a* is in cavity 620*b* and in tunnel 662. Tunnel 662 is located between front surface 602 and back surface 636. Tunnel 662 can be encircled by cushioning medium inside a pillow shell that is made of material layers similar to previous embodiments.

FIGS. 7A-C show another embodiment as pillow 700. Pillow 700 has a front surface 702 and a door 704 behind which is a hidden cavity. Door 704 has a cow front, and pillow back surface 736 shows a cow back, both of which may be appliqued, or may be three-dimensional attached sculptures, or may be indicia. FIG. 7C shows cavity 720 of pillow 700 similar to the cavity of the previous embodiments and having an additional feature of a structure 725 connected to cavity sidewall perimeter surface 722. Structure 725 represents a cow udder bridging a portion of cavity 720. A cow item (not shown) could be hidden inside cavity 720.

It is appreciated that one or more of the pillow doors need not overlap the respective cavity opening around the cavity's entire opening perimeter, especially if a portion of the cavity is otherwise concealed. For example, FIG. 8 shows a pillow 800 having a front surface 802 and a cavity 820 hidden behind door 804 and structure 825. Structure 825 bridges over the top of cavity 820 and is connected to front surface 802. Structure 825 can help hold items in cavity 820. Door 804 has pivot 806 and when door 804 is in a closed position mates with structure 825. In this embodiment, structure 825 visually illustrates a canoe. In use, items placed in cavity 820 appear to be in the canoe. When door 804 is in a closed position the items appearing to be in the canoe are concealed. In an alternative embodiment, door 804 could be large enough to conceal both the cavity and the structure.

FIG. 9 shows another embodiment of the present invention. Here, pillow 900 has a cavity 920 and first door 904*a* that reveals and conceals cavity 920. Another door 904*b* and yet another door 904*c* overlay first door 904*a*. The doors in this embodiment may function like leaves of a book and can have indicia that tell a story which is related to the theme of the pillow and an item placed in cavity 920.

FIG. 10 shows a pillow 11 of this invention assembled into a kit 10 with a blanket 12 and a container 14. Pillow 11 can be any one of the previously described pillows or variations thereof within the scope of the claims. Blanket 12 preferably has indicia that further indicates the illustrated theme of the pillow. Container 14 is shown as a draw string bag but it is appreciated that other containers could be used. Container 14 is preferably transparent such that the indicia of the pillow and the indicia of the blanket are visible. Container trim portion 16 can have matching indicia to make a kit that further visually indicates the illustrated theme of the pillow.

It is appreciated that other pillows shapes may be used to illustrate other themes. For example, a vehicle pillow outline could be used to illustrate a school bus theme where one or more of the school bus windows or other part of the bus could have concealing door. A building outline could be used to illustrate a building theme with lots of doors or windows, one or more of which have a concealing door, or a dog house building theme. A travel pillow theme could include items to play with during traveling. Other themes include holiday themes or religious themes such as a Christmas theme or nativity theme. A baby theme could have typical pastel colors such as pink or blue indicia and may have a lullaby or rattle sound, and/or could include a rattle item. A product pillow such as a "Coke-a-Cola"™ theme pillow could have a "Coke-a-Cola"™ fabric pattern and a polar bear item inside. A pillow could also be made custom to match existing furniture or made of popular print such as "Gingham"™ chex. It is also appreciated that other items could be placed in the hidden cavity besides stuffed animals, such as, dolls, crayons, books, cars, edibles, flowers or other items.

While the preferred embodiments of this invention have been illustrated and described, variations and modifications will be apparent to those skill in the art. Therefore, the scope and breadth of this invention is to be determined from the claims which follow.

The invention claimed is:

1. A theme pillow assembly, comprising:

a cushioning member, said cushioning member comprising a cushioning medium, a front surface and a back surface, said front surface and said back surface being connected along an outer perimeter of said cushioning member, said cushioning medium being between said front surface and said back surface;

a first cavity, said first cavity recessed from said front surface into said cushioning member, said first cavity comprising a first cavity opening of a predetermined dimension, a first cavity sidewall perimeter surface, and a first cavity floor surface of a similar predetermined dimension, said first cavity sidewall perimeter surface connected to said first cavity floor surface, and said first cavity sidewall perimeter surface encircled by said cushioning medium;

at least one item frictionally yet releasably situated in said first cavity;

a first door connected to said front surface, and said first door being bendable and openable to an open position for revealing all of said first cavity opening and closeable to a closed position over said first cavity for concealing at least a portion of said first cavity and said at least one item situated in said first cavity; and, a second door connected to said cushioning member, and a third door, said third door underlying said first door when said first door is in said closed position; and, wherein said first cavity sidewall perimeter surface billows inward toward said first cavity to frictionally yet releasably hold said at least one item;

wherein said first cavity opening generally maintains said predetermined dimension in said open position and in said closed position, and said first cavity floor surface generally maintains said similar predetermined dimension in said open position and in said closed position;

wherein said first cavity sidewall perimeter surface billows in between said first cavity opening and said first cavity floor surface, said first cavity sidewall perimeter surface at least partially obscuring said first cavity floor surface when said at least one item is frictionally yet releasably situated in said first cavity and when said first cavity is empty; and, wherein at least one of said cushioning member and said first door have indicia, said at least one item and said indicia together visually indicating an illustrated theme.

2. The theme pillow assembly of claim 1, wherein said at least one item comprises a stuffed animal.

3. The theme pillow assembly of claim 1, further comprising a tunnel, said tunnel comprising a tunnel opening in said first cavity sidewall perimeter surface, and said tunnel being a passageway located in between said front surface and said back surface.

4. The theme pillow assembly of claim 1, further comprising a sound device, and wherein said sound device is capable of emitting a sound that further indicates said illustrated theme.

5. The theme pillow assembly of claim 1, wherein said first cavity opening comprises a circumference and wherein said first door comprises a larger circumference than said first cavity opening circumference to overlay a portion of said front surface.

6. The theme pillow assembly of claim 1, wherein said outer perimeter of said cushioning member comprises a generally rectangular outline, said outline encircling a cushioning member frontal area, said first cavity opening encircling an opening area, and wherein said opening area is at least 18% of the size of said cushioning member frontal area.

7. The theme pillow assembly of claim 1, wherein said cushioning member comprises a shell, said shell housing, said cushioning medium, and said shell comprising quilted fabric material.

8. The theme pillow assembly of claim 1, wherein said first cavity floor surface is attached proximate to said back surface for preventing said first cavity sidewall perimeter surface and said first cavity floor surface from turning inside out.

9. The theme pillow assembly of claim 1, further including a securing device capable of securing said first door in said closed position, and wherein said securing device and said first door are connected to said front surface, said first door opening by bending and said first door generally conforming to said front surface in said closed position, said front surface being convexly contoured.

10. The theme pillow assembly of claim 1, further comprising a cover door and an opening in said first door, said cover door covering said opening in said first door in a closed position and exposing said opening in said first door in an open position, said cover door pivotally connected to said first door.

11. The theme pillow assembly of claim 1, wherein said first door and said second door conceal said first cavity when said first door and second door are in closed positions.

12. The theme pillow assembly of claim 1, further comprising an attached structure bridging at least a portion of said first cavity.

13. The theme pillow assembly of claim 1, wherein said outer perimeter of said cushioning member comprises an outline that is shaped to further visually indicate said illustrated theme.

14. The theme pillow assembly of claim 1, wherein said cushioning member comprises an outer perimeter surface, said outer perimeter surface connected to an outer perimeter of said front surface and connected to said back surface, said outer perimeter surface providing depth to said cushioning member.

15. The theme pillow assembly of claim 14, further comprising a second cavity, said second cavity having a second cavity perimeter sidewall surface which generally encircles a three dimensional void of said second cavity, said second cavity generally encircled by said cushioning medium.

16. The theme pillow assembly of claim 15, wherein said second cavity is in said outer perimeter surface and extending in an inward direction between said front surface and said back surface.

17. The theme pillow assembly of claim 15, further comprising a second door, said second door comprising a closed position for concealing said second cavity and an open position for revealing said second cavity.

18. The theme pillow kit, comprising:

a cushioning member, said cushioning member comprising a cushioning medium, a front surface and a back surface, said front surface and said back surface being connected along an outer perimeter of said cushioning member, said cushioning medium being between said front surface and said back surface;

a first cavity, said first cavity recessed from said front surface into said cushioning member, said first cavity comprising a first cavity opening of a predetermined dimension, a first cavity sidewall perimeter surface and a first cavity floor surface of a similar predetermined dimension, said first cavity sidewall perimeter surface connected to said first cavity floor surface, and said first cavity sidewall perimeter surface encircled by said cushioning medium;

at least one item frictionally yet releasably situated in said first cavity;

a first door connected to said front surface, and said first door being bendable and openable to an open position for revealing all of said first cavity opening and closeable to a closed position over said first cavity for concealing at least a portion of said first cavity and said at least one item situated in said first cavity; and a blanket, and a container, said container comprises a carrying bag sized to hold said theme pillow assembly and said blanket, said container comprising a transparent portion and trim portion, said trim portion comprising indicia that coordinates with said indicia on said at least one of said cushioning member and said first door, at least one of said blanket and said container having indicia that together with said cushioning member and said item visually indicates said illustrated theme; and, wherein said first cavity sidewall perimeter surface billows inward toward said first cavity to frictionally yet releasably hold said at least one item;

wherein said first cavity opening generally maintains said predetermined dimension in said open position and in said closed position and said first cavity floor surface generally maintains said similar predetermined dimension in said open position and in said closed position;

wherein said first cavity sidewall perimeter surface billows in between said first cavity opening and said first cavity floor surface, said first cavity sidewall perimeter surface at least partially obscuring said first cavity floor surface when said at least one item is frictionally yet releasably situated in said first cavity and when said first cavity is empty; and, wherein at least one of said cushioning member and said first door have indicia, said at least one item and said indicia together visually indicating an illustrated theme.

19. A theme pillow assembly, comprising:

a first layer of material;

a second layer of material connected to said first layer of material;

cushioning medium between said first layer and said second layer;

a cavity having an opening, said first layer of material including a front layer, a cavity sidewall perimeter layer and a cavity floor layer, said cavity sidewall perimeter layer being encircled by said cushioning medium, said cavity opening and said cavity floor layer similarly sized and similarly shaped, said cavity opening and said cavity floor layer generally maintaining said size and shape;

an item frictionally yet releasably stationed in said cavity by the cavity sidewall perimeter layer;

a third layer of material attached to said first layer of material, said third layer of material being a door covering at least a portion of said cavity opening, said third layer of material attached to pivotally open to an open position fully revealing said cavity opening and pivotally close to a closed position, said third layer attached in between said opening of said cavity and an outer perimeter of said first layer of material; and, a outer perimeter layer of material, said outer perimeter layer of material being connected to an outer perimeter of said first layer of material and an outer perimeter of said second layer of material, said outer perimeter layer of material providing depth to said theme pillow assembly;

a second cavity, said second cavity comprising a second cavity sidewall perimeter surface which generally encircles a three dimensional void of said second cavity, said second cavity generally encircled by said cushioning medium; and wherein at least one of said first layer of material and said third layer of material bear indicia that together with said item indicate a theme.

20. The theme pillow assembly of claim 19, wherein said item comprises a stuffed toy.

21. The theme pillow assembly of claim 19, further comprising a sound device.

22. The theme pillow assembly of claim 19, wherein said cavity opening comprises a circumference and wherein said third layer comprises a larger circumference than said cavity opening circumference to overlay a portion of said first layer of material.

23. The theme pillow assembly of claim 19, wherein said cavity floor layer is attached to said second layer for preventing said cavity sidewall perimeter layer and said cavity floor layer from turning inside out.

24. The theme pillow assembly of claim 19, wherein an outer perimeter of said theme pillow assembly comprises an outline that is shaped to further indicate said theme.

25. A theme pillow, comprising a first layer of material;

a second layer of material connected to said first layer of material;

cushioning medium between said first layer and said second layer;

a cavity having an opening, said first layer of material including a front layer, a cavity sidewall perimeter layer and a cavity floor layer, said cavity sidewall perimeter layer being encircled by said cushioning medium, said cavity opening and said cavity floor layer similarly sized and similarly shaped, said cavity opening and said cavity floor layer generally maintaining said size and shape;

an item frictionally yet releasably stationed in said cavity by the cavity sidewall perimeter layer;

a third layer of material attached to said first layer of material, said third layer of material being a door covering at least a portion of said cavity opening, said third layer of material attached to pivotally open to an open position fully revealing said cavity opening and pivotally close to a closed position, said third layer attached in between said opening of said cavity and an outer perimeter of said first layer of material; and, a tunnel, said tunnel comprising a tunnel opening in said cavity sidewall perimeter layer, and said tunnel being a passageway located in between said first layer and said second layer; and wherein at least one of said first layer of material and said third layer of material bear indicia that together with said item indicate a theme.

26. A theme pillow assembly for playing peek-a-boo hide and seek with at least one item, comprising:

a cushioning member, said cushioning member including a cushioning medium, a front surface and a back surface, said front surface and said back surface being connected along an outer perimeter of said cushioning member, said cushioning medium being between said front surface and said back surface;

a first cavity, said first cavity recessed from said front surface into said cushioning member, said first cavity having a first cavity opening, a first cavity sidewall perimeter surface and a first cavity floor surface, said first cavity sidewall perimeter surface connected to said first cavity floor surface, and said first cavity sidewall perimeter surface encircled by said cushioning medium;

at least one item removeably situated in said first cavity;

a first door connected to said front surface, and said first door openable to an open position for revealing at least a portion of said first cavity and closeable to a closed position over said first cavity for concealing said at least a portion of said first cavity and said at least one item situated in said first cavity;

further comprising an attached structure bridging at least a portion of said first cavity; and, wherein at least one of said cushioning member and said first door have indicia, said at least one item and said indicia together visually indicating an illustrated theme.

27. A theme pillow assembly for playing peek-a-boo hide and seek with at least one item, comprising:

a cushioning member, said cushioning member including a cushioning medium, a front surface and a back surface, said front surface and said back surface being connected along an outer perimeter of said cushioning member, said cushioning medium being between said front surface and said back surface;

a first cavity, said first cavity recessed from said front surface into said cushioning member, said first cavity having a first cavity opening, a first cavity sidewall perimeter surface and a first cavity floor surface, said first cavity sidewall perimeter surface connected to said first cavity floor surface, and said first cavity sidewall perimeter surface encircled by said cushioning medium;

at least one item removeably situated in said first cavity;

a first door connected to said front surface, and said first door openable to an open position for revealing at least a portion of said first cavity and closeable to a closed position over said first cavity for concealing said at least a portion of said first cavity and said at least one item situated in said first cavity;

a cover door and an opening in said first door, said cover door covering said opening in said first door in a closed position and exposing said opening in said first door in an open position, said cover door pivotally connected to said first door; and, wherein at least one of said cushioning member and said first door have indicia, said at least one item and said indicia together visually indicating an illustrated theme.

* * * * *